US009989872B2

(12) United States Patent
Nakamura et al.

(10) Patent No.: US 9,989,872 B2
(45) **Date of Patent: *Jun. 5, 2018**

(54) ELECTROSTATIC CHARGE IMAGE DEVELOPING TONER, ELECTROSTATIC CHARGE IMAGE DEVELOPER, AND TONER CARTRIDGE

(71) Applicant: FUJI XEROX CO., LTD., Tokyo (JP)

(72) Inventors: Yukiaki Nakamura, Kanagawa (JP); Akira Matsumoto, Kanagawa (JP); Yasuo Kadokura, Kanagawa (JP); Shinya Nakashima, Kanagawa (JP); Satoshi Miura, Kanagawa (JP); Sakiko Hirai, Kanagawa (JP); Shotaro Takahashi, Kanagawa (JP); Daisuke Tomita, Kanagawa (JP); Satoshi Kamiwaki, Kanagawa (JP); Masaru Takahashi, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days. days.

This patent is subject to a terminal disclaimer.

(21) Appl. No.: 15/492,584

(22) Filed: Apr. 20, 2017

(65) Prior Publication Data

US 2018/0059563 A1 Mar. 1, 2018

(30) Foreign Application Priority Data

Aug. 26, 2016 (JP) ..... 2016-166097
Feb. 13, 2017 (JP) ..... 2017-024392

(51) Int. Cl.
*G03G 9/08* (2006.01)
*G03G 9/087* (2006.01)
(Continued)

(52) U.S. Cl.
CPC ..... *G03G 9/08755* (2013.01); *G03G 9/0804* (2013.01); *G03G 9/0819* (2013.01);
(Continued)

(58) Field of Classification Search
CPC ..... G03G 9/08755; G03G 9/0926; G03G 9/0821; G03G 9/0825
(Continued)

(56) References Cited

U.S. PATENT DOCUMENTS

2009/0061345 A1 3/2009 Yamada et al.
2010/0227266 A1 9/2010 Ogawa et al.
(Continued)

FOREIGN PATENT DOCUMENTS

JP 2007-072333 A 3/2007
JP 2011-27869 * 2/2011
(Continued)

OTHER PUBLICATIONS

Oct. 3, 2017 Office Action issued in U.S. Appl. No. 15/491,145.
U.S. Appl. No. 15/491,145, filed Apr. 19, 2017 in the name of Kadokura et al.

*Primary Examiner* — Mark A Chapman
(74) *Attorney, Agent, or Firm* — Oliff PLC

(57) ABSTRACT

An electrostatic charge image developing toner includes toner particles each including an amorphous resin and a crystalline resin, wherein, when the toner particles are subjected to a measurement to determine an area ratio of the crystalline resin on a cross section of the toner particle before and after being heated at a temperature of 50° C. and a humidity of 50% RH for three days, a relationship between an area ratio a (%) of the crystalline resin on a cross section with respect to the toner particles before being heated, and an area ratio b (%) of the crystalline resin on the cross
(Continued)

section with respect to the toner particles after being heated satisfies Expression (1): $0.9 \leq a/b \leq 1.0$.

13 Claims, 2 Drawing Sheets

(51) Int. Cl.
*G03G 9/09* (2006.01)
*G03G 15/08* (2006.01)

(52) U.S. Cl.
CPC ..... *G03G 9/0821* (2013.01); *G03G 9/0825* (2013.01); *G03G 9/0902* (2013.01); *G03G 9/0918* (2013.01); *G03G 9/0926* (2013.01); *G03G 15/0865* (2013.01)

(58) Field of Classification Search
USPC ..... 430/109.4, 111.4
See application file for complete search history.

(56) References Cited

U.S. PATENT DOCUMENTS

| | | | | |
|---|---|---|---|---|
| 2011/0076610 | A1 | 3/2011 | Ogawa et al. | |
| 2013/0209931 | A1 | 8/2013 | Sato et al. | |
| 2016/0363877 | A1 * | 12/2016 | Hama | G03G 9/08755 |

FOREIGN PATENT DOCUMENTS

| | | | |
|---|---|---|---|
| JP | 2011-070001 | A | 4/2011 |
| JP | 2014-006339 | A | 1/2014 |

* cited by examiner

ELECTROSTATIC CHARGE IMAGE DEVELOPING TONER, ELECTROSTATIC CHARGE IMAGE DEVELOPER, AND TONER CARTRIDGE

CROSS-REFERENCE TO RELATED APPLICATIONS

This application is based on and claims priority under 35 USC 119 from Japanese Patent Application No. 2016-166097 filed Aug. 26, 2016 and Japanese Patent Application No. 2017-024392 filed Feb. 13, 2017.

BACKGROUND

1. Technical Field

The present invention relates to an electrostatic charge image developing toner, an electrostatic charge image developer, and a toner cartridge.

2. Related Art

In the electrophotographic image forming method, toners are used as image forming materials, and, for example, a toner including toner particles including a binder resin and a colorant, and an external additive that is externally added to the toner particles is widely used.

SUMMARY

According to an aspect of the present invention, there is provided an electrostatic charge image developing toner including:

toner particles each including an amorphous resin and a crystalline resin, wherein, when the toner particles are subjected to a measurement to determine an area ratio of the crystalline resin on a cross section of the toner particle before and after being heated at a temperature of 50° C. and a humidity of 50% RH for three days, a relationship between an area ratio a (%) of the crystalline resin on a cross section with respect to the toner particles before being heated, and an area ratio b (%) of the crystalline resin on the cross section with respect to the toner particles after being heated satisfies Expression (1): $0.9 \leq a/b \leq 1.0$.

BRIEF DESCRIPTION OF THE DRAWINGS

Exemplary embodiments of the present invention will be described in detail based on the following figures, wherein.

DETAILED DESCRIPTION

Figure 1:
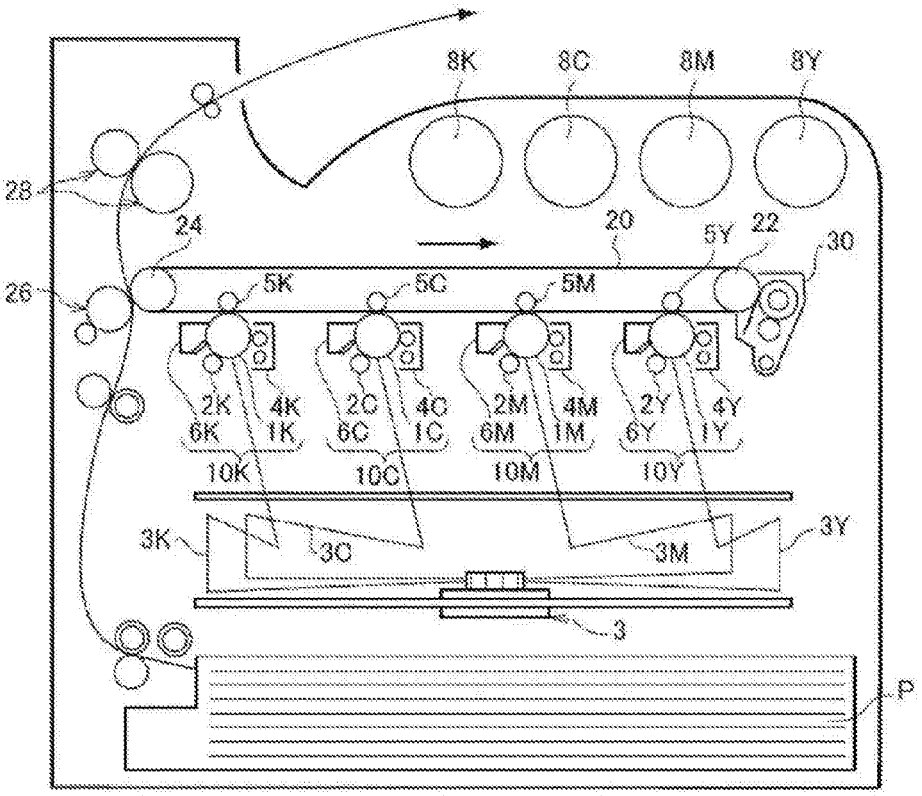
FIG. 1 is a schematic configuration diagram showing an image forming apparatus according to the exemplary embodiment.

Hereinafter, the exemplary embodiments which are an example of the invention will be described in detail.

Electrostatic Charge Image Developing Toner

An electrostatic charge image developing toner (hereinafter, also simply referred to as a "toner") according to the exemplary embodiment includes toner particles including an amorphous resin and a crystalline resin. When the toner particles are subjected to a measurement to determine an area ratio of the crystalline resin on a cross section of the toner particle before and after being heated at a temperature of 50° C. and a humidity of 50% RH for three days, a relationship between an area ratio a (%) of the crystalline resin on a cross section with respect to the toner particles before being heated and an area ratio b (%) of the crystalline resin on the cross section with respect to the toner particles after being heated satisfies Expression (1): $0.9 \leq a/b \leq 1.0$.

The area ratio of the crystalline resin indicates an area ratio of a crystalline resin which is phase-separated from an amorphous resin and is distinguished from the amorphous resin by dyeing with ruthenium tetroxide.

With the configuration described above, the toner according to the exemplary embodiment prevents an occurrence of toner filming (phenomenon in which the toner is adhered so as to have a film shape) which occurs when an image is formed at a fast process speed (for example, a feeding speed of a recording medium, which is equal to or higher than 445 mm/sec) in a high temperature and high humidity environment (for example, in an environment at a temperature of 35° C. and a humidity of 85% RH). A reason therefor is assumed as follows.

In recent years, in regards to a demand for energy saving, a technology of improving low temperature fixing properties of a toner, in order to reduce power consumption when fixing a toner image. As one technology, a toner including an amorphous resin and a crystalline resin in toner particles has been known. Meanwhile, from a viewpoint of ensuring heat resistance, a technology of forming a structure (sea-island structure) in which an amorphous resin and a crystalline resin are suitably phase-separated in the toner particles has been known.

However, even if an amorphous resin and a crystalline resin are suitably phase-separated, if the amorphous resin and the crystalline resin are compatible with each other, when an image is formed at a fast process speed (for example, a feeding speed of a recording medium, which is equal to or higher than 445 mm/sec) in a high temperature and high humidity environment (for example, in an environment at a temperature of 35° C. and a humidity of 85% RH), for example, a phenomenon (toner filming) in which the toner is adhered to a surface of an image holding member or a surface of a charging unit (for example, charging roll), an intermediate transfer member (for example, intermediate belt), or the like, so as to have a film shape may occur. If toner filming occurs, many stripe image defects are shown in an image.

If an image is formed at a fast process speed in a high temperature and high humidity environment, it is considered as follows. Heat or a mechanical load is intensively applied to the toner on the surface of the image holding member, or the surface of the charging unit (for example, charging roll), an intermediate transfer member (for example, intermediate belt), or the like, and thus toner particles are easily deformed or damaged, unlike a case where an image is formed at a general process speed (feeding speed of a recording medium, which is 224 mm/sec to 308 mm/sec) in a normal temperature environment (for example, in an environment at a temperature of 22° C. and a humidity of 55% RH). Thus, toner filming easily occurs.

Therefore, in the toner according to the exemplary embodiment, the phase-separated amount of the crystalline resin from the amorphous resin in the toner particles is large, and the compatible amount of the crystalline resin is decreased. That is, when the toner particles are heated at a temperature of 50° C. and a humidity of 50% RH for three days, a relationship between an area ratio a (%) of the crystalline resin on a cross section with respect to the toner particles before being heated and an area ratio b (%) of the crystalline resin on the cross section with respect to the toner particles after being heated satisfies Expression (1): $0.9 \leq a/b \leq 1.0$.

Here, if the toner particles are heated at a temperature of 50° C. and a humidity of 50% RH for three days, phase separation between the amorphous resin and the crystalline resin proceeds in the toner particles, and the amount of the crystalline resin compatible with the amorphous resin becomes zero or close to zero. If phase separation proceeds from a state of being compatible, the area ratio of the crystalline resin on the cross section of the toner particle is increased.

That is, the relationship between the area ratio a (%) of the crystalline resin on the cross section with respect to the toner particles before being heated and the area ratio b (%) of the crystalline resin on the cross section with respect to the toner particles after being heated satisfying Expression (1): $0.9 \leq a/b \leq 1.0$ means that heating causes the area ratio of the crystalline resin on the cross section of the toner particle not to fluctuate or to fluctuate small. This means that the amount of the crystalline resin phase-separated from the amorphous resin is large in toner particles before being heated and the compatible amount of the crystalline resin is zero or decreased. An expression of "a/b"=1.0 means that the compatible amount of the crystalline resin is zero in toner particles.

As the amount of the crystalline resin phase-separated from the amorphous resin (that is, amount of the island portion in the sea-island structure) is large in toner particles, toughness of toner particles is increased, and it is difficult that the toner particles are deformed or damaged. It is considered that this is because the filler effect of the crystalline resin constituting the island portion of the sea-island structure is improved.

That is, "a/b" in Expression (1) is set to be equal to or more than 0.9, and thus a state where a large amount of the crystalline resin is phase-separated from the amorphous resin (state where a large amount of an island portion is provided in a sea-island structure) is made. Thus, a filler effect is improved by the crystalline resin. Accordingly, even though an image is formed at a fast process speed (for example, a feeding speed of a recording medium, which is equal to or higher than 445 mm/sec) in a high temperature and high humidity environment (for example, in an environment at a temperature of 35° C. and a humidity of 85% RH) and heat or a mechanical load is intensively applied to the toner on the surface of the image holding member, or the surface of the charging unit (for example, charging roll), an intermediate transfer member (for example, intermediate belt), or the like, it is difficult that toner particles are deformed or damaged, and the occurrence of toner filming is prevented.

As described above, in the toner according to the exemplary embodiment, it is assumed that the occurrence of toner filming which occurs when an image is formed at a fast process speed in a high temperature and high humidity environment is prevented.

Even though, for example, an inorganic particle or an organic particle having a high glass transition temperature Tg is internally added to the toner particle, the toughness of the toner particle is improved by the filler effect, but molten viscosity of the toner particles themselves are increased. Thus, if an image is formed at a fast process speed, toner particles are molten and not cut during fixing. Thus, fixing poorness (for example, deterioration of bending strength of an image) occurs. On the contrary, in the toner according to the exemplary embodiment, toughness of toner particles is increased by using the filler effect of the crystalline resin, and thus it is difficult that fixing poorness occurs, and fixing properties are also ensured.

In the toner according to the exemplary embodiment, Expression (1): $0.9 \leq a/b \leq 1.0$ is satisfied. However, from a viewpoint of preventing the occurrence of toner filming, Expression (12): $0.92 \leq a/b \leq 1.0$ is preferably satisfied, and Expression (13): $0.94 \leq a/b \leq 1.0$ is more preferably satisfied.

"a/b" can be adjusted by a cooling rate after toner particles are formed, conditions of an annealing process, and the like.

Here, toner particles are heated from an environment at a temperature of 25° C. and a humidity of 50% RH to an environment at a temperature of 50° C. and a humidity of 50% RH, and then the temperature is kept for three days.

The area ratio of the crystalline resin on the cross section of the toner particle is measured in a manner that the cross section of the toner particle is observed in a state where the cross section of the toner particle is dyed with ruthenium, by using an image enlarged with a magnification of 30,000, which is obtained by a scanning electron microscope (SEM).

Specifically, a toner particle is mixed and embedded in an epoxy resin, and then the epoxy resin is solidified. The obtained solidified substance is cut by an ultra-microtome device (UltracutUCT manufactured by Leica Corporation), and thus a thin sample having a thickness of 80 nm to 130 nm is prepared. Then, the obtained thin sample is dyed with ruthenium tetroxide in a desiccator of 30° C. for three hours. An STEM observation image of the dyed thin sample in a transmission image mode is obtained by an ultrahigh resolution field-emission type scanning electron microscope (FE-SEM, S-4800 manufactured by Hitachi High-Technologies Corporation). The crystalline polyester resin and the release agent in the toner are distinguished from each other based on contrast and the shape. In the SEM image, regarding the crystalline resin dyed with ruthenium, a binder resin other than the release agent has many double-bond portions, and thus is dyed with ruthenium tetroxide in comparison to the amorphous resin, the release agent, and the like. Thus, the portion of the release agent and the portion of the resin other than the release agent are distinguished from each other. That is, regarding dyeing with ruthenium, the release agent is the most slightly-dyed domain, the crystalline resin (for example, crystalline polyester resin) is dyed the next, and the amorphous resin (for example, amorphous polyester resin) is dyed most densely. Contrast is adjusted, and thus the release agent can be determined as a domain which is observed to be white, the amorphous resin can be determined as a domain which is observed to be black, and the crystalline resin can be determined as a domain which is observed to be light gray. An image for the region of the crystalline resin, which is dyed with ruthenium is analyzed, and thus a percentage of an area of a region of the crystalline resin to the cross-sectional area of the toner particle is calculated. An average value of percentages obtained by performing this operation on 100 toner particles is set as the area ratio of the crystalline resin on the cross section of the toner particles.

In a case of a toner particle to which an external additive is externally added, the toner particle to which an external additive is externally added is set as a heating target and a target of measuring the area ratio of the crystalline resin.

In the toner according to the exemplary embodiment, a toner particle has a sea-island structure having a sea portion at which the amorphous resin is provided, and an island portion at which the crystalline resin is provided.

From a viewpoint of preventing the occurrence of toner filming, in the cross section of a toner particle, the domain diameter of the island portion including the crystalline resin (that is, domain of the crystalline resin) is preferably 5 nm to 500 nm, and more preferably 10 nm to 300 nm.

The domain diameter of the island portion at which the crystalline resin is provided (domain of the crystalline resin) is measured similarly to that for the area ratio of the crystalline resin, in a manner that the cross section of a toner particle is observed in a state where the cross section of the toner particle is dyed with ruthenium, by using an image enlarged with a magnification of 30,000, which is obtained by a scanning electron microscope (SEM).

That is, in the obtained SEM image, a long axis diameter of the region of the crystalline resin dyed with ruthenium (domain of the crystalline resin) is measured. Measurement of the long axis diameter is performed for 50 domains of the crystalline resin per cross section of one toner particle. An average value of long axis diameters of the domains of the crystalline resin obtained by performing this operation on 100 toner particles is set as the domain diameter of the crystalline resin.

From a viewpoint of preventing the occurrence of toner filming, in the cross section of a toner particle, the number of island portions including the crystalline resin (that is, the number of domains of the crystalline resin) is preferably 10 to 200 per unit area (1 μm×1 μm), and more preferably 20 to 100.

The number of island portions at which the crystalline resin is provided (the number of domains of the crystalline resin) is measured similarly to that for the area ratio of the crystalline resin, in a manner that the cross section of a toner particle is observed in a state where the cross section of the toner particle is dyed with ruthenium, by using an image enlarged with a magnification of 30,000, which is obtained by a scanning electron microscope (SEM).

That is, in the obtained SEM image, in a cross section of one toner particle, the number of regions of the crystalline resin, which are dyed with ruthenium (domains of the crystalline resin) are counted. This operation is performed on 100 toner particles, and an average value of the number of domains of the crystalline resin per unit area (1 μm×1 μm) is set as the number of domains of the crystalline resin.

Hereinafter, the toner according to the exemplary embodiment will be described in detail.

The toner according to the exemplary embodiment, for example, includes toner particles and an external additive.

Toner Particles

The toner particles include a binder resin. The toner particles may further include a colorant, a release agent, and other additives, if necessary.

Binder Resin

Examples of the binder resin include an amorphous resin and a crystalline resin.

A weight ratio between the amorphous resin and the crystalline resin (amorphous resin/crystalline resin) is preferably 50/50 to 97/3, and more preferably 70/30 to 93/7.

The content of the entire binder resin is preferably 40% by weight to 95% by weight, more preferably 50% by weight to 90% by weight, and even more preferably 60% by weight to 85% by weight with respect to the content of the toner particles.

Here, "crystallinity" of a resin indicates a resin having a clear endothermic peak without a stepwise change in the endothermic amount, in the differential scanning calorimetry (DSC) based on ASTMD 3418-8. Specifically, "crystallinity" indicates that a half value width of an endothermic peak when measurement is performed at a rate of temperature rise of 10 (° C./min) is within 10° C.

"Amorphism" of a resin indicates a case where a half value width is more than 10° C., a case where a stepwise change in the endothermic amount is shown, or a case where a clear endothermic peak is not recognized.

The amorphous resin will be described.

As the amorphous resin, well-known amorphous resins such as an amorphous polyester resin, an amorphous vinyl resin (for example, a styrene acrylic resin or the like), an epoxy resin, a polycarbonate resin, and a polyurethane resin are used, for example. Among these, an amorphous polyester resin and an amorphous vinyl resin (particularly, a styrene acrylic resin) are preferable and an amorphous polyester resin is more preferable, from viewpoints of low temperature fixing properties and chargeability of the toner.

Examples of the amorphous polyester resin include condensation polymers of polyvalent carboxylic acids and polyols. A commercially available product or a synthesized product may be used as the amorphous polyester resin.

Examples of the polyvalent carboxylic acid include aliphatic dicarboxylic acids (for example, oxalic acid, malonic acid, maleic acid, fumaric acid, citraconic acid, itaconic acid, glutaconic acid, succinic acid, alkenyl succinic acid, adipic acid, and sebacic acid), alicyclic dicarboxylic acids (for example, cyclohexanedicarboxylic acid), aromatic dicarboxylic acids (for example, terephthalic acid, isophthalic acid, phthalic acid, and naphthalenedicarboxylic acid), anhydrides thereof, or lower alkyl esters thereof (the alkyl group having from 1 to 5 carbon atoms, for example). Among these substances, for example, aromatic dicarboxylic acids are preferably used as the polyvalent carboxylic acid.

As the polyvalent carboxylic acid, a tri- or higher-valent carboxylic acid employing a crosslinked structure or a branched structure may be used in combination with a dicarboxylic acid. Examples of the tri- or higher-valent carboxylic acid include trimellitic acid, pyromellitic acid, anhydrides thereof, or lower alkyl esters (having, for example, from 1 to 5 carbon atoms) thereof.

The polyvalent carboxylic acids may be used singly or in combination of two or more types thereof.

Examples of the polyol include aliphatic diols (for example, ethylene glycol, diethylene glycol, triethylene glycol, propylene glycol, butanediol, hexanediol, and neopentyl glycol), alicyclic diols (for example, cyclohexanediol, cyclohexanedimethanol, and hydrogenated bisphenol A), and aromatic diols (for example, ethylene oxide adduct of bisphenol A and propylene oxide adduct of bisphenol A). Among these, for example, aromatic diols and alicyclic diols are preferably used, and aromatic diols are more preferably used as the polyol.

As the polyol, a tri- or higher-valent polyol employing a crosslinked structure or a branched structure may be used in combination together with diol. Examples of the tri- or higher-valent polyol include glycerin, trimethylolpropane, and pentaerythritol.

The polyol may be used singly or in combination of two or more types thereof.

A well-known preparing method is applied to prepare the amorphous polyester resin. Examples thereof include a method of conducting a reaction at a polymerization temperature of 180° C. to 230° C., if necessary, under reduced pressure in the reaction system, while removing water or an alcohol generated during condensation.

In the case in which monomers of the raw materials are not dissolved or compatibilized at a reaction temperature, a high-boiling-point solvent may be added as a solubilizing agent to dissolve the monomers. In this case, a polycondensation reaction is conducted while distilling away the solubilizing agent. In the case in which a monomer having poor compatibility is used, the monomer having poor compatibility and an acid or an alcohol to be polycondensed with the monomer may be previously condensed and then polycondensed with the main component.

Here, as the amorphous polyester resin, a modified amorphous polyester resin is also used, in addition to the unmodified amorphous polyester resin described above. The modified amorphous polyester resin is an amorphous polyester resin in which a bonding group other than an ester bond is present, and an amorphous polyester resin in which a resin component other than the amorphous polyester resin is bonded by covalent bonding or ionic bonding. As the modified amorphous polyester resin, usable is, for example, a resin including a terminal modified by allowing a reaction between an amorphous polyester resin which a functional group such as an isocyanate group capable of reacting with an acid group or a hydroxyl group is introduced to a terminal thereof, and an active hydrogen compound.

As the modified amorphous polyester resin, a urea-modified amorphous polyester resin (hereinafter, also simply referred to as a "urea-modified polyester resin") is preferable.

As the urea-modified polyester resin, a urea-modified polyester resin obtained by a reaction (at least one reaction of a crosslinking reaction and an extension reaction) between an amorphous polyester resin including an isocyanate group (amorphous polyester prepolymer) and an amine compound may be used. The urea-modified polyester resin may include a urea bond and a urethane bond.

As an amorphous polyester prepolymer including an isocyanate group, an amorphous polyester prepolymer obtained by allowing a reaction of a polyvalent isocyanate compound with respect to an amorphous polyester resin which is a polycondensate of a polyvalent carboxylic acid and a polyol and includes active hydrogen is used. Examples of a group including active hydrogen included in the amorphous polyester resin include a hydroxyl group (alcoholic hydroxyl group and phenolic hydroxyl group), an amino group, a carboxyl group, and a mercapto group, and an alcoholic hydroxyl group is preferable.

As polyvalent carboxylic acid and polyol of the amorphous polyester prepolymer including an isocyanate group, the compounds same as polyvalent carboxylic acid and polyol described in the section of the amorphous polyester resin are used.

Examples of a polyvalent isocyanate compound include aliphatic polyisocyanate (tetramethylene diisocyanate, hexamethylene diisocyanate, or 2,6-diisocyanato methyl caproate); alicyclic polyisocyanate (isophorone diisocyanate or cyclohexylmethane diisocyanate); aromatic diisocyanate (tolylene diisocyanate or diphenylmethane diisocyanate); aromatic aliphatic diisocyanate ($\alpha,\alpha,\alpha',\alpha'$-tetramethylxylylene diisocyanate); isocyanurates; and a component obtained by blocking the polyisocyanate by a blocking agent such as a phenol derivative, oxime, or caprolactam.

The polyvalent isocyanate compounds may be used singly or in combination of two or more kinds thereof.

A ratio of the polyvalent isocyanate compound is preferably from 1/1 to 5/1, more preferably from 1.2/1 to 4/1, and even more preferably from 1.5/1 to 2.5/1, as an equivalent ratio [NCO]/[OH] of an isocyanate group [NCO] and a hydroxyl group of an amorphous polyester prepolymer including a hydroxyl group [OH].

In the amorphous polyester prepolymer including an isocyanate group, the content of a component derived from the polyvalent isocyanate compound is preferably from 0.5% by weight to 40% by weight, more preferably from 1% by weight to 30% by weight, and even more preferably from 2% by weight to 20% by weight, with respect to the content of the entire amorphous polyester prepolymer including an isocyanate group.

The number of isocyanate groups contained per 1 molecule of the amorphous polyester prepolymer including an isocyanate group is preferably averagely equal to or greater than 1, more preferably averagely from 1.5 to 3, and even more preferably averagely from 1.8 to 2.5.

Examples of the amine compound to be reacted with the amorphous polyester prepolymer including an isocyanate group include diamine, tri- or higher valent polyamine, amino alcohol, amino mercaptan, amino acid, and a compound obtained by blocking these amino groups.

Examples of diamine include aromatic diamine (phenylene diamine, diethyl toluene diamine, or 4,4'diaminodiphenylmethane); alicyclic diamine (4,4'-diamino-3,3'dimethyl dicyclohexyl methane, diamine cyclohexane, or isophorone diamine); and aliphatic diamine (ethylenediamine, tetramethylenediamine, or hexamethylenediamine).

Examples of tri- or higher valent polyamine include diethylenetriamine and triethylenetetramine.

Examples of amino alcohol include ethanolamine and hydroxyethyl aniline.

Examples of amino mercaptan include aminoethyl mercaptan and aminopropyl mercaptan.

Examples of amino acid include aminopropionic acid and aminocaproic acid.

Examples of a compound obtained by blocking these amino groups include a ketimine compound and an oxazoline compound obtained from an amine compound such as diamine, tri- or higher valent polyamine, amino alcohol, amino mercaptan, or amino acid and a ketone compound (acetone, methyl ethyl ketone, or methyl isobutyl ketone).

Among these amine compounds, a ketimine compound is preferable.

The amine compounds may be used singly or in combination of two or more kinds thereof.

The urea-modified polyester resin may be a resin in which the molecular weight after the reaction is adjusted by adjusting a reaction between the amorphous polyester resin including an isocyanate group (amorphous polyester prepolymer) and an amine compound (at least one reaction of the crosslinking reaction and the extension reaction), using a stopper which stops at least one reaction of the crosslinking reaction and the extension reaction (hereinafter, also referred to as a "crosslinking/extension reaction stopper").

Examples of the crosslinking/extension reaction stopper include monoamine (diethylamine, dibutylamine, butylamine, or laurylamine) and a component obtained by blocking those (ketimine compound).

A ratio of the amine compound is preferably from 1/2 to 2/1, more preferably from 1/1.5 to 1.5/1, and even more preferably from 1/1.2 to 1.2/1, as an equivalent ratio [NCO]/[NHx] of an isocyanate group [NCO] of the amorphous polyester prepolymer including an isocyanate group and an amino group [NHx] of amines.

As the urea-modified polyester resin, a urea-modified polyester resin obtained by a reaction (at least one reaction of a crosslinking reaction and an extension reaction) between a polyester resin including an isocyanate group (hereinafter, referred to as a "polyester prepolymer") and an amine compound may be used. The urea-modified polyester resin may include a urea bond and a urethane bond.

As a polyester prepolymer, a reactant between polyester including a group including active hydrogen and a polyvalent isocyanate compound is used. Examples of a group including active hydrogen include a hydroxyl group (alcoholic hydroxyl group and phenolic hydroxyl group), an amino group, a carboxyl group, and a mercapto group, and an alcoholic hydroxyl group is preferable. Examples of a polyvalent isocyanate compound include aliphatic polyisocyanate (tetramethylene diisocyanate, hexamethylene diisocyanate, or 2,6-diisocyanato methyl caproate); alicyclic polyisocyanate (isophorone diisocyanate or cyclohexylmethane diisocyanate); aromatic diisocyanate (tolylene diisocyanate or diphenylmethane diisocyanate); aromatic aliphatic diisocyanate ($\alpha,\alpha,\alpha',\alpha'$-tetramethylxylylene diisocyanate); isocyanurates; and a compound obtained by blocking the polyisocyanate by a blocking agent such as a phenol derivative, oxime, or caprolactam. The polyvalent isocyanate compounds may be used singly or in combination of two or more kinds thereof.

The content of a component derived from the polyvalent isocyanate compound of the polyester prepolymer is preferably 0.5% by weight to 40% by weight, more preferably 1% by weight to 30% by weight, and even more preferably 2% by weight to 20% by weight, with respect to the content of the entire polyester prepolymer. The average number of isocyanate groups contained per 1 molecule of the polyester prepolymer is preferably equal to or greater than 1, more preferably 1.5 to 3, and even more preferably 1.8 to 2.5.

Examples of the amine compound to be reacted with the polyester prepolymer include diamine, tri- or higher valent polyamine, amino alcohol, amino mercaptan, amino acid, and a compound obtained by blocking an amino group of these amine compounds.

Examples of diamine include aromatic diamine (phenylene diamine, diethyl toluene diamine, or 4,4'diaminodiphenylmethane); alicyclic diamine (4,4'-diamino-3,3'dimethyl dicyclohexyl methane, diamine cyclohexane, or isophorone diamine); and aliphatic diamine (ethylenediamine, tetramethylenediamine, or hexamethylenediamine). Examples of tri- or higher valent polyamine include diethylenetriamine and triethylenetetramine. Examples of amino alcohol include ethanolamine and hydroxyethyl aniline. Examples of amino mercaptan include aminoethyl mercaptan and aminopropyl mercaptan. Examples of amino acid include aminopropionic acid and aminocaproic acid.

Examples of a compound obtained by blocking the amino group of the amine compound include a ketimine compound and an oxazoline compound derived from the amine compound and ketone compound (acetone, methyl ethyl ketone, or methyl isobutyl ketone).

As the amine compound, a ketimine compound is preferable. The amine compounds may be used singly or in combination of two or more kinds thereof.

The urea-modified polyester resin may be a resin in which the molecular weight after the reaction is adjusted by adjusting a reaction between the polyester prepolymer and an amine compound using a stopper which stops at least one reaction of the crosslinking reaction and the extension reaction (hereinafter, also referred to as a "crosslinking/extension reaction stopper"). Examples of the crosslinking/extension reaction stopper include monoamine (diethylamine, dibutylamine, butylamine, or laurylamine) and a compound obtained by blocking the amino group of monoamine (ketimine compound).

The characteristics of the amorphous resin will be described.

The glass transition temperature (Tg) of the amorphous resin is preferably 50° C. to 80° C., and more preferably 50° C. to 65° C.

The glass transition temperature is obtained by a DSC curve which is obtained by a differential scanning calorimetry (DSC), and more specifically, is obtained by "Extrapolating Glass Transition Starting Temperature" disclosed in a method for obtaining the glass transition temperature of "Testing Methods for Transition Temperatures of Plastics" in JIS K-7121-1987.

The weight average molecular weight (Mw) of the amorphous resin is preferably 5,000 to 1,000,000 and more preferably 7,000 to 500,000.

The number average molecular weight (Mn) of the amorphous resin is preferably 2,000 to 100,000.

The molecular weight distribution Mw/Mn of the amorphous resin is preferably 1.5 to 100 and more preferably 2 to 60.

The weight average molecular weight and the number average molecular weight are measured by gel permeation chromatography (GPC). The molecular weight measurement by GPC is performed by using GPC.HLC-8120 GPC manufactured by Tosoh Corporation as a measuring device, TSKGEL SUPERHM-M (15 cm) manufactured by Tosoh Corporation, as a column, and a THF solvent. The weight average molecular weight and the number average molecular weight are calculated using a calibration curve of molecular weight obtained with a monodisperse polystyrene standard sample from the measurement results obtained from the measurement.

The crystalline resin will be described.

As the crystalline resin, well-known crystalline resins such as a crystalline polyester resin and a crystalline vinyl resin (for example, a polyalkylene resin or a long-chain alkyl (meth)acrylate resin) are used. Among these, a crystalline polyester resin is preferable from viewpoints of mechanical toughness and low temperature fixing properties of the toner.

Examples of the crystalline polyester resin include condensation polymers of polyvalent carboxylic acids and polyols. A commercially available product or a synthesized product may be used as the crystalline polyester resin.

Here, form the viewpoint that a crystal structure is easily formed, as the crystalline polyester resin, a polycondensate prepared using a polymerizable monomer having a straight aliphatic group is preferable to that prepared using a polymerizable monomer having an aromatic group.

Examples of the polyvalent carboxylic acid include aliphatic dicarboxylic acids (e.g., oxalic acid, succinic acid, glutaric acid, adipic acid, suberic acid, azelaic acid, sebacic acid, 1,9-nonane dicarboxylic acid, 1,10-decane dicarboxylic acid, 1,12-dodecane dicarboxylic acid, 1,14-tetra decane dicarboxylic acid, and 1,18-octadecane dicarboxylic acid), aromatic dicarboxylic acids (e.g., phthalic acid, isophthalic acid, terephthalic acid, dibasic acid of naphthalene-2,6-dicarboxylic acid), anhydrides thereof, or lower alkyl esters (having, for example, from 1 to 5 carbon atoms) thereof.

As the polyvalent carboxylic acid, a tri- or higher-valent carboxylic acid employing a crosslinked structure or a branched structure may be used in combination with a dicarboxylic acid. Examples of the trivalent carboxylic acid include aromatic carboxylic acid (e.g., 1,2,3-benzenetricarboxylic acid, 1,2,4-benzenetricarboxylic acid, and 1,2,4-naphthalene tricarboxylic acid), anhydrides thereof, or lower alkyl esters (having, for example, from 1 to 5 carbon atoms) thereof.

As the polyvalent carboxylic acid, a dicarboxylic acid having a sulfonic acid group and a dicarboxylic acid having an ethylenic double bond may be used in combination with the dicarboxylic acids described above.

The polyvalent carboxylic acids may be used singly or in combination of two or more kinds thereof.

Examples of the polyol include aliphatic diols (e.g., linear aliphatic diol having 7 to 20 carbon atoms of main chain part). Examples of aliphatic diols include ethylene glycol, 1,3-propanediol, 1,4-butanediol, 1,5-pentanediol, 1,6-hexanediol, 1,7-heptane diol, 1,8-octanediol, 1,9-nonanediol, 1,10-decanediol, 1,11-undecanediol, 1,12-dodecane diol, 1,13-tri-decanediol, 1,14-tetradecanediol, 1,18-octadecanediol, and 1,14-eicosanedecanediol. Among these, 1,8-octanediol, 1,9-nonanediol, and 1,10-decanediol are preferable as aliphatic diols.

As the polyol, a tri- or higher-valent alcohol employing a crosslinked structure or a branched structure may be used in combination with a diol. Examples of the tri- or higher-valent polyol include glycerin, trimethylolethane, trimethylolpropane, and pentaerythritol.

The polyols may be used singly or in combination of two or more kinds thereof.

Here, in the polyol, the content of aliphatic diol may be suitably 80 mol % or more and is more preferably 90 mol % or more.

A well-known preparing method is applied to prepare the crystalline polyester resin, in the same manner as in the amorphous polyester resin.

The characteristics of the crystalline resin will be described.

A melting temperature of the crystalline resin is preferably 50° C. to 100° C., more preferably 55° C. to 90° C., and even more preferably 60° C. to 85° C.

The melting temperature is obtained from "melting peak temperature" described in the method of obtaining a melting temperature in JIS K7121-1987 "Testing Methods for Transition Temperatures of Plastics", from a DSC curve obtained by differential scanning calorimetry (DSC).

A weight average molecular weight (Mw) of the crystalline resin is preferably 6,000 to 35,000.

Colorant

Examples of the colorant include various pigments such as carbon black, chrome yellow, Hansa yellow, benzidine yellow, threne yellow, quinoline yellow, pigment yellow, permanent orange GTR, pyrazolone orange, vulcan orange, watchung red, permanent red, brilliant carmine 3B, brilliant carmine 6B, DuPont oil red, pyrazolone red, lithol red, Rhodamine B Lake, Lake Red C, pigment red, rose bengal, aniline blue, ultramarine blue, calco oil blue, methylene blue chloride, phthalocyanine blue, pigment blue, phthalocyanine green, and malachite green oxalate; and various dyes such as acridine dyes, xanthene dyes, azo dyes, benzoquinone dyes, azine dyes, anthraquinone dyes, thioindigo dyes, dioxadine dyes, thiazine dyes, azomethine dyes, indigo dyes, phthalocyanine dyes, aniline black dyes, polymethine dyes, triphenylmethane dyes, diphenylmethane dyes, and thiazole dyes.

The colorants may be used singly or in combination of two or more types thereof.

As the colorant, the surface-treated colorant may be used, if necessary. The colorant may be used in combination with a dispersing agent. Plural colorants may be used in combination.

The content of the colorant is, for example, preferably 1% by weight to 30% by weight, more preferably 3% by weight to 15% by weight with respect to a total amount of the toner particles.

Release Agent

Examples of the release agent include hydrocarbon waxes; natural waxes such as carnauba wax, rice wax, and candelilla wax; synthetic or mineral/petroleum waxes such as montan wax; and ester waxes such as fatty acid esters and montanic acid esters. The release agent is not limited thereto.

The melting temperature of the release agent is preferably 50° C. to 110° C. and more preferably 60° C. to 100° C.

The melting temperature is obtained from "melting peak temperature" described in the method of obtaining a melting temperature in JIS K 7121-1987 "Testing methods for transition temperatures of plastics", from a DSC curve obtained by differential scanning calorimetry (DSC).

The content of the release agent is, for example, preferably 1% by weight to 20% by weight, and more preferably 5% by weight to 15% by weight with respect to the total amount of the toner particles.

Other Additives

Examples of other additives include well-known additives such as a magnetic material, a charge-controlling agent, and an inorganic particle. The toner particles include these additives as internal additives.

Characteristics of Toner Particles

The toner particles may be toner particles having a single-layer structure, or toner particles having a so-called core/shell structure composed of a core (core particle) and a coating layer (shell layer) coated on the core.

Here, the toner particles having a core/shell structure may be configured with, for example, a core including a binder resin, and if necessary, other additives such as a colorant and a release agent, and a coating layer including a binder resin.

The volume average particle diameter (D50v) of the toner particles is preferably 2 μm to 10 μm, and more preferably 4 μm to 8 μm.

Various average particle diameters and various particle size distribution indices of the toner particles are measured by using a COULTER MULTISIZER II (manufactured by Beckman Coulter, Inc.) and ISOTON-II (manufactured by Beckman Coulter, Inc.) as an electrolyte.

In the measurement, from 0.5 mg to 50 mg of a measurement sample is added to 2 ml of a 5% aqueous solution of surfactant (preferably sodium alkylbenzene sulfonate) as a dispersing agent. The obtained material is added to from 100 ml to 150 ml of the electrolyte.

The electrolyte in which the sample is suspended is subjected to a dispersion treatment using an ultrasonic disperser for 1 minute, and a particle size distribution of particles having a particle diameter of from 2 μm to 60 μm is measured by a COULTER MULTISIZER II using an aperture having an aperture diameter of 100 μm. 50,000 particles are sampled.

Cumulative distributions by volume and by number are drawn from the side of the smallest diameter with respect to particle size ranges (channels) separated based on the measured particle size distribution. The particle diameter when the cumulative percentage becomes 16% is defined as that corresponding to a volume average particle diameter D16v and a number average particle diameter D16p, while the particle diameter when the cumulative percentage becomes 50% is defined as that corresponding to a volume average particle diameter D50v and a number average particle diameter D50p. Furthermore, the particle diameter when the cumulative percentage becomes 84% is defined as that corresponding to a volume average particle diameter D84v and a number average particle diameter D84p.

Using these, a volume average particle size distribution index (GSDv) is calculated as $(D84v/D16v)^{1/2}$, while a number average particle size distribution index (GSDp) is calculated as $(D84p/D16p)^{1/2}$.

An average circularity of the toner particles is preferably 0.94 to 1.00 and more preferably 0.95 to 0.98.

The average circularity of the toner particles is determined by an expression of (perimeter of equivalent circle diameter)/(perimeter) [(perimeter of a circle having the same projected area as that of a particle image)/(perimeter of particle projection image)]. Specifically, the average circularity thereof is a value measured using the following method.

First, the toner particles which is a measurement target are sucked and collected, a flat flow is formed, stroboscopic light emission is instantly performed to obtain a particle image as a still image, and the average circularity is determined using a flow-type particle image analysis device (FPIA-2100 manufactured by Sysmex Corporation) which performs image analysis of the particle image. 3,500 particles are sampled when determining the average circularity.

In a case where the toner includes an external additive, the toner (developer) which is a measurement target is dispersed in water including a surfactant, and then, the ultrasonic treatment is performed to obtain toner particles from which the external additive is removed.

Brilliant Toner Particle

Here, the toner particle may be a brilliant toner particle including a brilliant pigment. The brilliant toner particle may further include a colorant, if necessary, in addition to the brilliant pigment.

Regarding components and characteristics of the brilliant toner particle, which are the same as those of the toner particle, descriptions thereof will be omitted.

Brilliant Pigment

Examples of the brilliant pigment include a pigment (brilliant pigment) which may impart brilliant feeling like metal gloss. Specific examples of the brilliant pigment include metal powder of aluminum (metal of Al singleton), brass, bronze, nickel, stainless steel, zinc, and the like; mica coated with titanium oxide, yellow iron oxide, and the like; a coated thin inorganic crystalline base such as barium sulfate, layered silicate, and layered aluminum; single crystal plate titanium oxide; basic carbonate; bismuth oxychloride; natural guanine; thin glass powder; and thin glass powder on which metal is deposited. The brilliant pigment is not particularly limited as long as a pigment has brilliance.

Among brilliant pigments, in particular, from a viewpoint of mirror reflection intensity, metal powder is preferable. In metal powder, aluminum is most preferable. Aluminum has high brilliance and a high effect to filming from the above-described filler effect.

The shape of the brilliant pigment is preferably flake-shaped (flaky).

An average length of the brilliant pigment in a long-axis direction is preferably 1 μm to 30 μm, more preferably 3 μm to 20 μm, and further preferably 5 μm to 15 μm.

A ratio (aspect ratio) of an average length of the brilliant pigment in the long-axis direction when an average length of the brilliant pigment in a thickness direction is set to 1 is preferably 5 to 200, more preferably 10 to 100, and further preferably 30 to 70.

Each of the average lengths and the aspect ratio of the brilliant pigment are measured by the following method. A picture of pigment particles is captured at magnification (of 300 to 100,000) allowing measurement by using a scanning electron microscope (S-4800 manufactured by Hitachi High-Technologies Corporation). The length of each particle in a long-axis direction and the length thereof in a thickness direction are measured, and an average length and an aspect ratio of the brilliant pigment in the long-axis direction are calculated, in a state where the obtained image of the pigment particles makes a two-dimensional image.

The content of the brilliant pigment is, for example, preferably 1 part by weight to 50 parts by weight, and more preferably 15 parts by weight to 25 parts by weight, with respect to 100 parts by weight of toner particles.

Characteristics of Brilliant Toner Particles

Brilliance

"Brilliance" in the brilliant toner particle indicates that brightness like metal gloss is provided when an image formed by a toner (also referred to as "a brilliant toner" below) including brilliant toner particles is visually recognized.

Specifically, in a case where a solid image has been formed, in the brilliant toner, a ratio (X/Y) between reflectance X at a light-receiving angle of +30° and reflectance Y at a light-receiving angle of −30° which are measured when the image is irradiated with incident light having an incident angle of −45° by a goniophotometer is preferably 2 to 100.

The ratio (X/Y) being equal to or more than 2 indicates that reflection to an opposite side (positive angle side) of a side to which the light is incident is performed larger than that to the side (negative angle side) to which the incident light is incident, that is, indicates that irregular reflection of the incident light is prevented. In a case where irregular reflection in which incident light is reflected in various directions occurs, if the reflected light is visually recognized, the color is viewed to be dull. Thus, in a case where the ratio (X/Y) is less than 2, even though the reflected light is visually recognized, recognition of gloss may be not possible, and brilliance may be deteriorated.

If the ratio (X/Y) is more than 100, a viewing angle allowing the reflected light to be visually recognized is too narrow, and a specularly-reflected light component is large. Thus, substantially black may be viewed in accordance with an angle of viewing.

From a point of brilliance of an image and preparation properties of the brilliant toner particle, the ratio (X/Y) is more preferably 4 to 50, further preferably 6 to 20, and particularly preferably 8 to 15.

Measurement of Ratio (X/Y) by Goniophotometer

Here, firstly, an incident angle and a light-receiving angle will be described. When measurement by a goniophotometer is performed, an incident angle is set to −45°. This is because measurement sensitivity is high for an image having glossiness in a wide range.

The reason of setting a light-receiving angle to −30° and +30° is because measurement sensitivity is highest when an image having a brilliant feeling and an image which does not have a brilliant feeling are evaluated.

Next, a measuring method of the ratio (X/Y) will be described.

Incident light having an incident angle of −45° is incident to an image to be measured (brilliant image), and reflectance X at a light-receiving angle of +30° and reflectance Y at a light-receiving angle of −30° are measured by using a spectroscopic goniometric color difference meter GC5000L (manufactured by Nippon Denshoku Industries Co., Ltd) as a goniophotometer. The reflectance X and the reflectance Y are measured for light having a wavelength in a range of 400 nm to 700 nm, at an interval of 20 nm. An average value of the reflectances at each of the wavelengths is obtained. The ratio (X/Y) is calculated from measurement results.

From a viewpoint of satisfying the above-described ratio (X/Y), a brilliant toner particle preferably satisfies requirements of (1) and (2) as follows.

(1) An average equivalent circle diameter D of brilliant toner particles is longer than an average maximum thickness C.

(2) In a case where cross sections of brilliant toner particles in a thickness direction are observed, a percentage of a brilliant pigment in which an angle between a long-axis direction of the cross sections of the brilliant toner particles and a long-axis direction of the brilliant pigment is in a range of −30° to +30° is equal to or more than 60% of the entire observed brilliant pigments.

The followings are considered. If the brilliant toner particle is thick, but has a flake shape in which an equivalent circle diameter is long, in a fixing process when an image is formed, pressure during fixing causes flaky brilliant toner particles to be arranged so as to have a flaky surface side of the brilliant toner particle, which opposes a surface of a recording medium.

Thus, it is considered that, among flaky brilliant pigments contained in the brilliant toner particle, brilliant pigments which satisfy the requirement (described in (2)) that "an angle between a long-axis direction of the cross sections of the brilliant toner particles and a long-axis direction of the brilliant pigment is in a range of −30° to +30° " are arranged to cause a surface side on which an area is the maximum to oppose the surface of a recording medium. In a case where an image formed in this manner is irradiated with light, it is considered that the percentage of the brilliant pigment which causes irregular reflection with respect to incident light is reduced, and thus the range of the above-described ratio (X/Y) is achieved.

Average Maximum Thickness C and Average Equivalent Circle Diameter D of Brilliant Toner Particles It is preferable that the brilliant toner particles are flaky and has an average equivalent circle diameter D which is longer than the average maximum thickness C. A ratio (C/D) between the average maximum thickness C and the average equivalent circle diameter D is more preferably in a range of 0.001 to 0.500, further preferably in a range of 0.010 to 0.200, and particularly preferably in a range of 0.050 to 0.100.

The ratio (C/D) is equal to or more than 0.001, and thus toughness of a toner is ensured, and breaking by stress when an image is formed is prevented. In addition, degradation of charging by exposing a pigment, and an occurrence of fog which occurs as a result of degradation of charging are prevented. The ratio (C/D) is equal to or less than 0.500, and thus excellent brilliance is obtained.

The average maximum thickness C and the average equivalent circle diameter D of brilliant toner particles are measured by the following method.

The brilliant toner particles are placed on a smooth surface, vibration is applied, and thus the brilliant toner particles are dispersed so as not to be irregular. 1,000 brilliant toner particles are enlarged with a magnification of 1,000 by a color laser microscope "VK-9700" (manufactured by Keyence Corporation), and the maximum thickness C among the brilliant toner particles and the equivalent circle diameter D of a surface viewed from the top are measured. Arithmetic mean values of the measured values are obtained, and thus the average maximum thickness C and the average equivalent circle diameter D are calculated.

Angle Between Long-Axis Direction on Cross Sections of Brilliant Toner Particles and Long-Axis Direction of Brilliant Pigment In a case where cross sections of brilliant toner particles in a thickness direction are observed, the percentage (on the basis of the number of pieces) of the brilliant pigment in which the angle between a long-axis direction on the cross section of the brilliant toner particle and a long-axis direction of the brilliant pigment is in a range of −30° to +30° is preferably equal to or more than 60% of the entire observed brilliant pigments. Further, the percentage is more preferably 70% to 95%, and particularly preferably 80% to 90%.

The percentage is equal to or more than 60%, and thus excellent brilliance is obtained.

Here, an observing method of a cross section of a brilliant toner particle will be described.

Brilliant toner particles are embedded by using a bisphenol A type epoxy resin liquid and a curing agent, and thus a sample for cutting is prepared. Then, the sample for cutting is cut at −100° C. by using a cutting machine which uses a diamond knife, for example, an ultra-microtome device (UltracutUCT, manufactured by Leica Corporation), thereby an observation sample is prepared. The observation sample is observed by an ultrahigh resolution field-emission type scanning electron microscope (S-4800 manufactured by Hitachi High-Technologies Corporation) at magnification at which brilliant toner particles of about 1 to 10 are viewed in one field of vision.

Specifically, cross sections of brilliant toner particles (cross sections of the brilliant toner particles in a thickness direction) are observed. Regarding the 100 observed brilliant toner particles, the number of brilliant pigments in which an angle between the long-axis direction on the cross section of the brilliant toner particle and the long-axis direction of the brilliant pigment is in a range of −30° to +30° are counted, and the percentage is calculated. The counting is performed by using, for example, image analysis software (Win ROOF) manufactured by Mitani Corporation or by using an output sample of the observation image and a protractor.

The "long-axis direction on a cross section of a brilliant toner particle" indicates a direction orthogonal to a thickness direction of the above-described brilliant toner particle in which an average equivalent circle diameter D is longer than an average maximum thickness C. The "long-axis direction of a brilliant pigment" indicates a length direction of a brilliant pigment.

Volume Average Particle Diameter of Brilliant Toner Particles

A volume average particle diameter of brilliant toner particles is preferably 1 μm to 30 μm, and more preferably 3 μm to 20 μm.

External Additives

As the other external additives, inorganic particles are used, for example. Examples of the inorganic particles include $SiO_2$, $TiO_2$, $Al_2O_3$, CuO, ZnO, $SnO_2$, $CeO_2$, $Fe_2O_3$, MgO, BaO, CaO, $K_2O$, $Na_2O$, $ZrO_2$, $CaO.SiO_2$, $K_2O.(TiO_2)n$, $Al_2O_3.2SiO_2$, $CaCO_3$, $MgCO_3$, $BaSO_4$, and $MgSO_4$.

The surfaces of the inorganic particles as the external additive may be treated with a hydrophobizing agent. The hydrophobizing treatment is performed by, for example, dipping the inorganic particles in a hydrophobizing agent. The hydrophobizing agent is not particularly limited and examples thereof include a silane coupling agent, silicone oil, a titanate coupling agent, and an aluminum coupling agent. These may be used singly or in combination of two or more kinds thereof.

Generally, the amount of the hydrophobizing agent is, for example, 1 part by weight to 10 parts by weight with respect to 100 parts by weight of the inorganic particles.

Examples of the external additives also include resin particles (resin particles such as polystyrene, polymethyl methacrylate (PMMA), and melamine resin) and a cleaning aid (for example, a metal salt of higher fatty acid represented by zinc stearate, and fluorine polymer particles).

The amount of the external additives externally added is, for example, preferably 0.01% by weight to 5% by weight, and more preferably 0.01% by weight to 2.0% by weight with respect to the amount of the toner particles.

Preparing Method of Toner

Next, a preparing method of the toner according to the exemplary embodiment will be described.

The toner according to the exemplary embodiment is obtained by externally adding an external additive to toner particles, after preparing the toner particles.

The toner particles may be prepared using any of a dry preparing method (e.g., kneading and pulverizing method) and a wet preparing method (e.g., aggregation and coalescence method, suspension and polymerization method, and dissolution and suspension method). The toner particle preparing method is not particularly limited to these preparing methods, and a known preparing method is employed.

First, a toner particle preparing method using an aggregation and coalescence method will be described.

The toner particles are prepared through the processes of: preparing a resin particle dispersion in which resin particles as a binder resin are dispersed (resin particle dispersion preparation process); aggregating the resin particles (if necessary, other particles) in the resin particle dispersion (if necessary, in the dispersion after mixing with other particle dispersions) to form aggregated particles (aggregated particle forming process); and heating the aggregated particle dispersion in which the aggregated particles are dispersed, to aggregate and coalesce the aggregated particles, thereby forming toner particles (aggregation and coalescence process).

Here, as the resin particle dispersion, an amorphous resin particle dispersion in which amorphous resin particles are dispersed, and a crystalline resin particle dispersion in which crystalline resin particles are dispersed are applied. As the resin particle dispersion, an amorphous resin particle dispersion in which resin particles including the amorphous resin and the crystalline resin are dispersed may also be applied.

Hereinafter, the processes will be described below in detail.

In the following description, a method of obtaining toner particles containing a colorant and a release agent will be described, but a colorant and a release agent is used, if necessary. Other additives may be used, in addition to a colorant and a release agent.

Resin Particle Dispersion Preparation Process

First, for example, a colorant particle dispersion in which colorant particles are dispersed and a release agent particle dispersion in which release agent particles are dispersed are prepared together with a resin particle dispersion in which resin particles as a binder resin are dispersed.

The resin particle dispersion is prepared by, for example, dispersing resin particles in a dispersion medium using a surfactant.

Examples of the dispersion medium used for the resin particle dispersion include aqueous mediums.

Examples of the aqueous mediums include water such as distilled water and ion exchange water, and alcohols. These may be used singly or in combination of two or more kinds thereof.

Examples of the surfactant include anionic surfactants such as a sulfuric ester salt, a sulfonate, a phosphate ester, and a soap; cationic surfactants such as an amine salt and a quaternary ammonium salt; and nonionic surfactants such as polyethylene glycol, an ethylene oxide adduct of alkyl phenol, and polyol. Among these, anionic surfactants and cationic surfactants are particularly preferably used. Nonionic surfactants may be used in combination with anionic surfactants or cationic surfactants.

The surfactants may be used singly or in combination of two or more kinds thereof.

Regarding the resin particle dispersion, as a method of dispersing the resin particles in the dispersion medium, a common dispersing method using, for example, a rotary shearing-type homogenizer, or a ball mill, a sand mill, or a DYNO mill having media is exemplified. Depending on the kind of the resin particles, resin particles may be dispersed in the resin particle dispersion according to, for example, a phase inversion emulsification method.

The phase inversion emulsification method includes: dissolving a resin to be dispersed in a hydrophobic organic solvent in which the resin is soluble; conducting neutralization by adding abase to an organic continuous phase (O phase); and converting the resin (so-called phase inversion) from W/O to O/W by putting an aqueous medium (W phase) to form a discontinuous phase, thereby dispersing the resin as particles in the aqueous medium.

A volume average particle diameter of the resin particles dispersed in the resin particle dispersion is, for example, preferably 0.01 μm to 1 μm, more preferably 0.08 μm to 0.8 μm, and even more preferably 0.1 μm to 0.6 μm.

Regarding the volume average particle diameter of the resin particles, a cumulative distribution by volume is drawn from the side of the smallest diameter with respect to particle size ranges (channels) separated using the particle size distribution obtained by the measurement with a laser diffraction-type particle size distribution measuring device (for example, LA-700 manufactured by Horiba, Ltd.), and a particle diameter when the cumulative percentage becomes 50% with respect to the entire particles is measured as a volume average particle diameter D50v. The volume average particle diameter of the particles in other dispersions is also measured in the same manner.

The content of the resin particles contained in the resin particle dispersion is, for example, preferably 5% by weight to 50% by weight, and more preferably 10% by weight to 40% by weight.

For example, the colorant particle dispersion and the release agent particle dispersion are also prepared in the same manner as in the case of the resin particle dispersion. That is, the particles in the resin particle dispersion are the same as the colorant particles dispersed in the colorant particle dispersion and the release agent particles dispersed in the release agent particle dispersion, in terms of the volume average particle diameter, the dispersion medium, the dispersing method, and the content of the particles.

Aggregated Particle Forming Process

Next, the colorant particle dispersion and the release agent dispersion are mixed together with the resin particle dispersion.

The resin particles, the colorant particles, and the release agent particles are heterogeneously aggregated in the mixed dispersion, thereby forming aggregated particles having a diameter near a target toner particle diameter and including the resin particles, the colorant particles, and the release agent particles.

Specifically, for example, an aggregating agent is added to the mixed dispersion and a pH of the mixed dispersion is adjusted to acidity (for example, the pH is 2 to 5). If necessary, a dispersion stabilizer is added. Then, the mixed dispersion is heated at a temperature of the glass transition temperature of the resin particles (specifically, for example, from a temperature 30° C. lower than the glass transition temperature of the resin particles to 10° C. lower than the glass transition temperature) to aggregate the particles dispersed in the mixed dispersion, thereby forming the aggregated particles.

In the aggregated particle forming process, for example, the aggregating agent may be added at room temperature (for example, 25° C.) under stirring of the mixed dispersion using a rotary shearing-type homogenizer, the pH of the mixed dispersion may be adjusted to be acidic (for example, the pH is 2 to 5), a dispersion stabilizer may be added if necessary, and then the heating may be performed.

Examples of the aggregating agent include a surfactant having an opposite polarity to the polarity of the surfactant used as the dispersing agent to be added to the mixed dispersion, an inorganic metal salt, and a bi- or higher-valent metal complex. Particularly, when a metal complex is used as the aggregating agent, the amount of the surfactant used is reduced and charging characteristics are improved.

If necessary, an additive may be used which forms a complex or a similar bond with the metal ions of the aggregating agent. A chelating agent is preferably used as the additive.

Examples of the inorganic metal salt include a metal salt such as calcium chloride, calcium nitrate, barium chloride, magnesium chloride, zinc chloride, aluminum chloride, and aluminum sulfate, and inorganic metal salt polymer such as polyaluminum chloride, polyaluminum hydroxide, and calcium polysulfide.

A water-soluble chelating agent may be used as the chelating agent. Examples of the chelating agent include oxycarboxylic acids such as tartaric acid, citric acid, and gluconic acid, iminodiacetic acid (IDA), nitrilotriacetic acid (NTA), and ethylenediaminetetraacetic acid (EDTA).

An addition amount of the chelating agent is, for example, preferably in a range of 0.01 parts by weight to 5.0 parts by weight, and more preferably in a range of 0.1 parts by weight to less than 3.0 parts by weight relative to 100 parts by weight of the resin particles.

Coalescence Process

Next, the aggregated particle dispersion in which the aggregated particles are dispersed is heated at, for example, a temperature that is equal to or higher than the glass transition temperature of the resin particles (for example, a temperature that is higher than the glass transition temperature of the resin particles by 10° C. to 30° C.) to coalesce the aggregated particles and form toner particles.

Toner particles are obtained through the foregoing processes.

After the aggregated particle dispersion in which the aggregated particles are dispersed is obtained, toner particles may be prepared through the processes of: further mixing the resin particle dispersion in which the resin particles are dispersed with the aggregated particle dispersion to conduct aggregation so that the resin particles further adhere to the surfaces of the aggregated particles, thereby forming second aggregated particles; and aggregating and coalescing the second aggregated particles by heating the second aggregated particle dispersion in which the second aggregated particles are dispersed, thereby forming toner particles having a core/shell structure.

Here, the resin particles attached to the surface of the aggregated particles may be the amorphous resin particles.

After the aggregation and coalescence process ends, the toner particles formed in the solution are subjected to a washing process, a solid-liquid separation process, and a drying process, that are well known, and thus dry toner particles are obtained.

In the washing process, preferably, displacement washing using ion exchange water is sufficiently performed from the viewpoint of charging properties. In addition, the solid-liquid separation process is not particularly limited, and suction filtration, pressure filtration, or the like may be performed from the viewpoint of productivity. The method for the drying process is also not particularly limited, and freeze drying, flush drying, fluidized drying, vibration-type fluidized drying, or the like may be performed from a viewpoint of productivity.

Next, a case of preparing the toner particles including the urea-modified polyester resin (urea-modified amorphous polyester resin) will be described.

The toner particles including the urea-modified polyester resin may be obtained by a dissolution and suspension method described below. A method of obtaining toner particles including the urea-modified polyester resin (urea-modified amorphous polyester resin) and an unmodified crystalline polyester resin as binder resins will be described, but toner particles may include an unmodified amorphous polyester resin as the binder resin. A method of obtaining toner particles including a colorant and a release agent will be described, but the colorant and the release agent are components included in the toner particles, if necessary.

Oil-Phase Solution Preparation Process

An oil-phase solution obtained by dissolving or dispersing a toner particle material including an unmodified crystalline polyester resin (hereinafter, also simply referred to as a "crystalline polyester resin"), an amorphous polyester prepolymer including an isocyanate group, an amine compound, a colorant, and a release agent in an organic solvent is prepared (oil-phase solution preparation process). This oil-phase solution preparation process is a process of dissolving or dispersing the toner particle material in an organic solvent to obtain a mixed solution of the toner material.

The oil-phase solution is prepared by methods such as 1) a method of preparing an oil-phase solution by collectively dissolving or dispersing the toner material in an organic solvent, 2) a method of preparing an oil-phase solution by kneading the toner material in advance and dissolving or dispersing the kneaded material in an organic solvent, 3) a method of preparing an oil-phase solution by dissolving the crystalline polyester resin, the amorphous polyester prepolymer including an isocyanate group, and the amine compound in an organic solvent and dispersing a colorant and the release agent in the organic solvent, 4) a method of preparing an oil-phase solution by dispersing a colorant and the release agent in the organic solvent and dissolving the crystalline polyester resin, the amorphous polyester prepolymer including an isocyanate group, and the amine compound in the organic solvent, 5) a method of preparing an oil-phase solution by dissolving or dispersing toner particle materials other than the amorphous polyester prepolymer including an isocyanate group and the amine compound (the crystalline polyester resin, a colorant, and a release agent) in an organic solvent and dissolving the amorphous polyester prepolymer including an isocyanate group and the amine compound in the organic solvent, or 6) a method of preparing an oil-phase solution by dissolving or dispersing toner particle materials other than the amorphous polyester prepolymer including an isocyanate group or the amine compound (the crystalline polyester resin, a colorant, and a release agent) in an organic solvent and dissolving the amorphous polyester prepolymer including an isocyanate group or the amine compound in the organic solvent. The method of preparing the oil-phase solution is not limited thereto.

Examples of the organic solvent of the oil-phase solution include an ester solvent such as methyl acetate or ethyl acetate; a ketone solvent such as methyl ethyl ketone or methyl isopropyl ketone; an aliphatic hydrocarbon solvent such as hexane or cyclohexane; a halogenated hydrocarbon solvent such as dichloromethane, chloroform or trichloroethylene. It is preferable that these organic solvents dissolve the binder resin, a rate of the organic solvent dissolving in water is from approximately 0% by weight to 30% by weight, and a boiling point is equal to or lower than 100° C. Among the organic solvents, ethyl acetate is preferable.

Suspension Preparation Process

Next, a suspension is prepared by dispersing the obtained oil-phase solution in a water-phase solution (suspension preparation process).

A reaction between the amorphous polyester prepolymer including an isocyanate group and the amine compound is performed together with the preparation of the suspension. The urea-modified polyester resin is formed by the reaction. The reaction is performed with at least one reaction of the crosslinking reaction and the extension reaction of molecular chains. The reaction between the amorphous polyester prepolymer including an isocyanate group and the amine compound may be performed with the following organic solvent removing process.

Here, the reaction conditions are selected according to reactivity between the structure of isocyanate group included in the amorphous polyester prepolymer and the amine compound. As an example, a reaction time is preferably 10 minutes to 40 hours and more preferably 2 hours to 24 hours. A reaction temperature is preferably 0° C. to 150° C. and more preferably 40° C. to 98° C. In addition, a well-known catalyst (dibutyltin laurate or di-octyltin laurate) may be used if necessary, in the formation of the urea-modified polyester resin. That is, a catalyst may be added to the oil-phase solution or the suspension.

As the water-phase solution, a water-phase solution obtained by dispersing a particle dispersing agent such as an organic particle dispersing agent or an inorganic particle dispersing agent in an aqueous solvent is used. In addition, as the water-phase solution, a water-phase solution obtained by dispersing a particle dispersing agent in an aqueous solvent and dissolving a polymer dispersing agent in an aqueous solvent is also used. Further, a well-known additive such as a surfactant may be added to the water-phase solution.

As the aqueous solvent, water (for example, generally ion exchange water, distilled water, or pure water) is used. The aqueous solvent may be a solvent containing water and an organic solvent such as alcohol (methanol, isopropyl alcohol, or ethylene glycol), dimethylformamide, tetrahydrofuran, cellosolves (methyl cellosolve), or lower ketones (acetone or methyl ethyl ketone).

As the organic particle dispersing agent, a hydrophilic organic particle dispersing agent is used. As the organic particle dispersing agent, particles of poly (meth)acrylic acid alkyl ester resin (for example, a polymethyl methacrylate resin), a polystyrene resin, or a poly(styrene-acrylonitrile) resin are used. As the organic particle dispersing agent, particles of a styrene acrylic resin are also used.

As the inorganic particle dispersing agent, a hydrophilic inorganic particle dispersing agent is used. Specific examples of the inorganic particle dispersing agent include particles of silica, alumina, titania, calcium carbonate, magnesium carbonate, tricalcium phosphate, clay, diatomaceous earth, or bentonite, and particles of calcium carbonate are preferable. The inorganic particle dispersing agent may be used singly or in combination of two or more kinds thereof.

The surface of the particle dispersing agent may be subjected to surface treatment by a polymer including a carboxyl group.

As the polymer including a carboxyl group, a copolymer of at least one kind selected from salts (alkali metal salt, alkaline earth metal salt, ammonium salt, amine salt) in which α,β-monoethylenically unsaturated carboxylic acid or a carboxyl group of α,β-monoethylenically unsaturated carboxylic acid is neutralized by alkali metal, alkaline earth metal, ammonium, or amine, and α,β-monoethylenically unsaturated carboxylic acid ester is used. As the polymer including a carboxyl group, salt (alkali metal salt, alkaline earth metal salt, ammonium salt, amine salt) in which a carboxyl group of a copolymer of α,β-monoethylenically unsaturated carboxylic acid and α,β-monoethylenically unsaturated carboxylic acid ester is neutralized by alkali metal, alkaline earth metal, ammonium, or amine is also used. The polymer including a carboxyl group may be used singly or in combination with two or more kinds thereof.

Representative examples of α,β-monoethylenically unsaturated carboxylic acid include α,β-unsaturated monocarboxylic acid (acrylic acid, methacrylic acid, or crotonic acid), and α,β-unsaturated dicarboxylic acids (maleic acid, fumaric acid, or itaconic acid). Representative examples of α,β-monoethylenically unsaturated carboxylic acid ester include alkyl esters of (meth)acrylate, (meth)acrylate including an alkoxy group, (meth)acrylate including a cyclohexyl group, (meth)acrylate including a hydroxy group, and polyalkylene glycol mono(meth)acrylate.

As the polymer dispersing agent, a hydrophilic polymer dispersing agent is used. As the polymer dispersing agent, specifically a polymer dispersing agent which includes a carboxyl group and does not include lipophilic group (hydroxypropoxy group or a methoxy group) (for example, water-soluble cellulose ether such as carboxymethyl cellulose or carboxyethyl cellulose) is used.

Solvent Removing Process

Next, a toner particle dispersion is obtained by removing an organic solvent from the obtained suspension (solvent removing process). The solvent removing process is a process of forming toner particles by removing the organic solvent contained in liquid droplets of the water-phase solution dispersed in the suspension. The method of removing the organic solvent from the suspension may be performed immediately after the suspension preparation process or may be performed after 1 minute or longer, after the suspension preparation process.

In the solvent removing process, the organic solvent may be removed from the suspension by cooling or heating the obtained suspension to have a temperature in a range of 0° C. to 100° C., for example.

As a specific method of the organic solvent removing method, the following method is used.

(1) A method of allowing airflow to blow to the suspension to forcibly update a gas phase on the surface of the suspension. In this case, gas may flow into the suspension.

(2) A method of reducing pressure. In this case, a gas phase on the surface of the suspension may be forcibly updated due to filling of gas or gas may further blow into the suspension.

The toner particles are obtained through the above-mentioned processes.

Here, after the organic solvent removing process ends, the toner particles formed in the toner particle dispersion are subjected to a well-known washing process, a well-known solid-liquid separation process, a well-known drying process, and thereby dried toner particles are obtained.

Regarding the washing process, replacing washing using ion exchanged water may preferably be sufficiently performed for charging properties.

The solid-liquid separation process is not particularly limited, but suction filtration, pressure filtration, or the like may preferably be performed for productivity. The drying process is not particularly limited, but freeze drying, flush drying, fluidized drying, vibrating fluidized drying, and the like may preferably be performed for productivity.

Next, an annealing process will be described.

In the preparing process of toner particles, for example, an annealing process (heating process) may be performed with respect to the toner particles obtained through the processes described above.

Specifically, for example, the obtained toner particles are heated up to a temperature of 40° C. to 70° C., and then are kept at the temperature for a period in a range of 0.5 hours to 15 hours. With the process, phase separation between a crystalline resin and an amorphous resin in the obtained toner particles sufficiently proceeds. Accordingly, in the toner, Expression (1): $0.9 \leq a/b \leq 1.0$ is easily satisfied.

The performing time of the annealing process is not limited as described above, as long as the process of extremely changing the "state in which the amorphous resin and the crystalline resin are compatible with each other" of the toner particles (process of setting the Expression (1): $0.9 \leq a/b \leq 1.0$ not to be satisfied in the toner) is performed after the annealing process, and, for example, the annealing process may be performed with a dispersion formed as the toner particles or in a slurry state in which the amount of the solvent of the dispersion is decreased.

Additionally, the following process may be performed. Firstly, a dispersion obtained by re-dispersing the obtained toner particles in a dispersion medium (for example, water or the like) is obtained. In the toner particle dispersion, after increasing the temperature to a temperature equal to or higher than the glass transition temperature of the amorphous polyester resin (specifically, preferably equal to or higher than the glass transition temperature of the amorphous polyester resin by +5° C. and more preferably equal to or higher than the glass transition temperature of the amorphous polyester resin by +10° C.), and the temperature is kept for 0.5 hours to 10 hours (preferably 2 hours to 8 hours). After that, the toner particles are rapidly cooled (for example, rapidly cooled preferably at 3° C./min to 30° C./min and more preferably at 5° C./min to 20° C./min). With the process, toner particles in which compatibilization of an amorphous resin and a crystalline resin excessively proceeds are obtained. After that, if the annealing process is performed under the above condition, toner particles in which phase separation between a crystalline resin and an amorphous resin proceeds, and dispersibility of a domain of the phase-separated crystalline resin is high (that is, toner particles having an improved filler effect of a crystalline resin) are easily obtained from the obtained toner particles, and thus the occurrence of toner filming is easily prevented.

In a case where toner particles are prepared by an aggregation and coalescence method, in an aggregation and coalescence process, the toner particles are held at a temperature of aggregation and coalescence for a period of 0.5 hours to 20 hours (preferably, 5 hours to 15 hours). Then, the toner particles are rapidly cooled under the above conditions, and thus it is possible to obtain toner particles in which compatibilization of an amorphous resin and a crystalline resin excessively proceeds. After that, if the annealing process is performed under the above condition, toner particles in which phase separation between a crystalline resin and an amorphous resin proceeds, and dispersibility of a domain of the phase-separated crystalline resin is high (that is, toner particles having an improved filler effect of a crystalline resin) are easily obtained from the obtained toner particles, and thus the occurrence of toner filming is easily prevented.

The toner according to the exemplary embodiment is prepared, for example, in a manner that an external additive is added and mixed to the obtained and dried toner particles. The mixing may be performed in a V blender, a HENSCHEL MIXER, a Lodige mixer, and the like. Further, if necessary, coarse toner particles may be removed with a vibration classifier, a wind classifier, and the like.

Electrostatic Charge Image Developer

An electrostatic charge image developer according to the exemplary embodiment includes at least the toner according to the exemplary embodiment.

The electrostatic charge image developer according to the exemplary embodiment may be a single-component developer including only the toner according to the exemplary embodiment or may be a two-component developer obtained by mixing the toner and a carrier.

The carrier is not particularly limited and known carriers are exemplified. Examples of the carrier include a coating carrier in which surfaces of cores formed of magnetic particles are coated with a coating resin; magnetic particles dispersion-type carrier in which magnetic particles is dispersed and blended in a matrix resin; and a resin impregnation-type carrier in which porous magnetic particles are impregnated with a resin.

The magnetic particle dispersion-type carrier and the resin impregnation-type carrier may be carriers in which constituent particles of the carrier are cores and coated with a coating resin.

Examples of the magnetic particles include magnetic metals such as iron, nickel, and cobalt, and magnetic oxides such as ferrite and magnetite.

Examples of the resin for coating and matrix resin include polyethylene, polypropylene, polystyrene, polyvinyl acetate, polyvinyl alcohol, polyvinyl butyral, polyvinyl chloride, polyvinyl ether, polyvinyl ketone, a vinyl chloride-vinyl acetate copolymer, a styrene-acrylic acid ester copolymer, a straight silicone resin configured to include an organosiloxane bond or a modified product thereof, a fluorine resin, polyester, polycarbonate, a phenol resin, and an epoxy resin.

The coating resin and the matrix resin may contain other additives such as conductive materials.

Examples of the conductive particles include particles of metals such as gold, silver, and copper, carbon black particles, titanium oxide particles, zinc oxide particles, tin oxide particles, barium sulfate particles, aluminum borate particles, and potassium titanate particles.

Here, a coating method using a coating layer forming solution in which a coating resin, and if necessary, various additives are dissolved in an appropriate solvent is used to coat the surface of a core with the coating resin. The solvent is not particularly limited, and may be selected in consideration of the coating resin to be used, coating suitability, and the like.

Specific examples of the resin coating method include a dipping method of dipping cores in a coating layer forming solution, a spraying method of spraying a coating layer forming solution to surfaces of cores, a fluid bed method of spraying a coating layer forming solution in a state in which cores are allowed to float by flowing air, and a kneader-coater method in which cores of a carrier and a coating layer forming solution are mixed with each other in a kneader-coater and the solvent is removed.

The mixing ratio (weight ratio) between the toner and the carrier in the two-component developer is preferably 1:100 to 30:100, and more preferably 3:100 to 20:100 (toner: carrier).

Image Forming Apparatus and Image Forming Method

An image forming apparatus and an image forming method according to the exemplary embodiment will be described.

The image forming apparatus according to the exemplary embodiment is provided with an image holding member, a charging unit that charges a surface of the image holding member, an electrostatic charge image forming unit that forms an electrostatic charge image on the charged surface of the image holding member, a developing unit that contains a container that contains an electrostatic charge image developer and develops the electrostatic charge image formed on the surface of the image holding member with the electrostatic charge image developer as a toner image, a transfer unit that transfers the toner image formed onto the surface of the image holding member to a surface of a recording medium, and a fixing unit that fixes the toner image transferred onto the surface of the recording medium. As the electrostatic charge image developer, the electrostatic charge image developer according to the exemplary embodiment is applied.

In the image forming apparatus according to the exemplary embodiment, an image forming method (image forming method according to the exemplary embodiment) including the processes of: charging a surface of an image holding member; forming an electrostatic charge image on the charged surface of the image holding member; developing the electrostatic charge image formed on the surface of the image holding member with the electrostatic charge image developer according to the exemplary embodiment as a toner image; transferring the toner image formed onto the surface of the image holding member to a surface of a recording medium; and fixing the toner image transferred onto the surface of the recording medium is performed.

As the image forming apparatus according to the exemplary embodiment, a known image forming apparatus is applied, such as a direct transfer type apparatus that directly transfers a toner image formed on a surface of an image holding member onto a recording medium; an intermediate transfer type apparatus that primarily transfers a toner image formed on a surface of an image holding member onto a surface of an intermediate transfer member, and secondarily transfers the toner image transferred to the surface of the intermediate transfer member onto a surface of a recording medium; an apparatus that is provided with a cleaning unit that cleans a surface of an image holding member before charging after transfer of a toner image; or an apparatus that is provided with an erasing unit that irradiates, after transfer of a toner image, a surface of an image holding member with erase light before charging for erasing.

In the case of an intermediate transfer type apparatus, a transfer unit is configured to have, for example, an intermediate transfer member having a surface to which a toner image is to be transferred, a primary transfer unit that primarily transfers a toner image formed on a surface of an image holding member onto the surface of the intermediate transfer member, and a secondary transfer unit that secondarily transfers the toner image transferred onto the surface of the intermediate transfer member onto a surface of a recording medium.

In the image forming apparatus according to the exemplary embodiment, for example, a part including the developing unit may have a cartridge structure (process cartridge) that is detachable from the image forming apparatus. As the process cartridge, for example, a process cartridge that includes a container that contains the electrostatic charge image developer according to the exemplary embodiment and is provided with a developing unit is suitably used.

Hereinafter, an example of the image forming apparatus according to the exemplary embodiment will be shown. However, the image forming apparatus is not limited thereto. Main portions shown in the drawing will be described, but descriptions of other portions will be omitted.

FIG. 1 is a schematic configuration diagram showing the image forming apparatus according to the exemplary embodiment.

The image forming apparatus shown in FIG. 1 is provided with first to fourth electrophotographic image forming units 10Y, 10M, 10C, and 10K (image forming units) that output yellow (Y), magenta (M), cyan (C), and black (K) images based on color-separated image data, respectively. These image forming units (hereinafter, may be simply referred to as "units") 10Y, 10M, 10C, and 10K are arranged side by side at predetermined intervals in a horizontal direction. These units 10Y, 10M, 10C, and 10K may be process cartridges that are detachable from the image forming apparatus.

An intermediate transfer belt 20 as an intermediate transfer member is installed above the units 10Y, 10M, 10C, and 10K in the drawing to extend through the units. The intermediate transfer belt 20 is wound on a driving roll 22 and a support roll 24 contacting the inner surface of the intermediate transfer belt 20, which are disposed to be separated from each other on the left and right sides in the drawing, and travels in a direction toward the fourth unit 10K from the first unit 10Y. The support roll 24 is pressed in a direction in which it departs from the driving roll 22 by a spring or the like (not shown), and a tension is given to the intermediate transfer belt 20 wound on both of the rolls. In addition, an intermediate transfer member cleaning device 30 opposed to the driving roll 22 is provided on a surface of the intermediate transfer belt 20 on the image holding member side.

Developing devices (developing units) 4Y, 4M, 4C, and 4K of the units 10Y, 10M, 10C, and 10K are supplied with toner including four color toner, that is, a yellow toner, a magenta toner, a cyan toner, and a black toner accommodated in toner cartridges 8Y, 8M, 8C, and 8K, respectively.

The first to fourth units 10Y, 10M, 10C, and 10K have the same configuration, and accordingly, only the first unit 10Y that is disposed on the upstream side in a traveling direction of the intermediate transfer belt to form a yellow image will be representatively described here. The same parts as in the first unit 10Y will be denoted by the reference numerals with magenta (M), cyan (C), and black (K) added instead of yellow (Y), and descriptions of the second to fourth units 10M, 10C, and 10K will be omitted.

The first unit 10Y has a photoreceptor 1Y acting as an image holding member. Around the photoreceptor 1Y, a charging roll (an example of the charging unit) 2Y that charges a surface of the photoreceptor 1Y to a predetermined potential, an exposure device (an example of the electrostatic charge image forming unit) 3 that exposes the charged surface with laser beams 3Y based on a color-separated image signal to form an electrostatic charge image, a developing device (an example of the developing unit) 4Y that supplies a charged toner to the electrostatic charge image to develop the electrostatic charge image, a primary transfer roll (an example of the primary transfer unit) 5Y that transfers the developed toner image onto the intermediate transfer belt 20, and a photoreceptor cleaning device (an example of the cleaning unit) 6Y that removes the toner remaining on the surface of the photoreceptor 1Y after primary transfer, are arranged in sequence.

The primary transfer roll 5Y is disposed inside the intermediate transfer belt 20 to be provided at a position opposed to the photoreceptor 1Y. Furthermore, bias supplies (not shown) that apply a primary transfer bias are connected to the primary transfer rolls 5Y, 5M, 5C, and 5K, respectively. Each bias supply changes a transfer bias that is applied to each primary transfer roll under the control of a controller (not shown).

Hereinafter, an operation of forming a yellow image in the first unit 10Y will be described.

First, before the operation, the surface of the photoreceptor 1Y is charged to a potential of −600 V to −800 V by the charging roll 2Y.

The photoreceptor 1Y is formed by laminating a photosensitive layer on a conductive substrate (for example, volume resistivity at 20° C.: $1\times10^{-6}$ Ωcm or less). The photosensitive layer typically has high resistance (that is about the same as the resistance of a general resin), but has properties in which when laser beams 3Y are applied, the specific resistance of a part irradiated with the laser beams changes. Accordingly, the laser beams 3Y are output to the charged surface of the photoreceptor 1Y via the exposure device 3 in accordance with image data for yellow sent from the controller (not shown). The laser beams 3Y are applied to the photosensitive layer on the surface of the photoreceptor 1Y, whereby an electrostatic charge image of a yellow image pattern is formed on the surface of the photoreceptor 1Y.

The electrostatic charge image is an image that is formed on the surface of the photoreceptor 1Y by charging, and is a so-called negative latent image, that is formed by irradiating the photosensitive layer with laser beams 3Y so that the specific resistance of the irradiated part is lowered to cause charges to flow on the surface of the photoreceptor 1Y, while charges stay on a part which is not irradiated with the laser beams 3Y.

The electrostatic charge image formed on the photoreceptor 1Y is rotated up to a predetermined developing position with the travelling of the photoreceptor 1Y. The electrostatic charge image on the photoreceptor 1Y is visualized (developed) as a toner image at the developing position by the developing device 4Y.

The developing device 4Y accommodates, for example, an electrostatic charge image developer including at least a yellow toner and a carrier. The yellow toner is frictionally charged by being stirred in the developing device 4Y to have a charge with the same polarity (negative polarity) as the charge that is on the photoreceptor 1Y, and is thus held on the developer roll (an example of the developer holding member). By allowing the surface of the photoreceptor 1Y to pass through the developing device 4Y, the yellow toner electrostatically adheres to the erased latent image part on the surface of the photoreceptor 1Y, whereby the latent image is developed with the yellow toner. Next, the photoreceptor 1Y having the yellow toner image formed thereon continuously travels at a predetermined rate and the toner image developed on the photoreceptor 1Y is transported to a predetermined primary transfer position.

When the yellow toner image on the photoreceptor 1Y is transported to the primary transfer position, a primary transfer bias is applied to the primary transfer roll 5Y and an electrostatic force toward the primary transfer roll 5Y from the photoreceptor 1Y acts on the toner image, whereby the toner image on the photoreceptor 1Y is transferred onto the intermediate transfer belt 20. The transfer bias applied at this time has the opposite polarity (+) to the toner polarity (−), and, for example, is controlled to +10 μA in the first unit 10Y by the controller (not shown).

On the other hand, the toner remaining on the photoreceptor 1Y is removed and collected by the photoreceptor cleaning device 6Y.

The primary transfer biases that are applied to the primary transfer rolls 5M, 5C, and 5K of the second unit 10M and the subsequent units are also controlled in the same manner as in the case of the first unit.

In this manner, the intermediate transfer belt 20 onto which the yellow toner image is transferred in the first unit 10Y is sequentially transported through the second to fourth units 10M, 10C, and 10K, and the toner images of respective colors are multiply-transferred in a superimposed manner.

The intermediate transfer belt 20 onto which the four color toner images have been multiply-transferred through the first to fourth units reaches a secondary transfer part that is composed of the intermediate transfer belt 20, the support roll 24 contacting the inner surface of the intermediate transfer belt, and a secondary transfer roll (an example of the secondary transfer unit) 26 disposed on the image holding surface side of the intermediate transfer belt 20. Meanwhile, a recording sheet (an example of the recording medium) P is supplied to a gap between the secondary transfer roll 26 and the intermediate transfer belt 20, that contact with each other, via a supply mechanism at a predetermined timing, and a secondary transfer bias is applied to the support roll 24. The transfer bias applied at this time has the same polarity (−) as the toner polarity (−), and an electrostatic force toward the recording sheet P from the intermediate transfer belt 20 acts on the toner image, whereby the toner image on the intermediate transfer belt 20 is transferred onto the recording sheet P. In this case, the secondary transfer bias is determined depending on the resistance detected by a resistance detector (not shown) that detects the resistance of the secondary transfer part, and is voltage-controlled.

Thereafter, the recording sheet P is fed to a pressure-contacting part (nip part) between a pair of fixing rolls in a fixing device (an example of the fixing unit) 28 so that the toner image is fixed to the recording sheet P, whereby a fixed image is formed.

Examples of the recording sheet P onto which a toner image is transferred include plain paper that is used in electrophotographic copying machines, printers, and the like. As a recording medium, an OHP sheet is also exemplified other than the recording sheet P.

The surface of the recording sheet P is preferably smooth in order to further improve smoothness of the image surface after fixing. For example, coated paper obtained by coating a surface of plain paper with a resin or the like, art paper for printing, and the like are preferably used.

The recording sheet P on which the fixing of the color image is completed is discharged toward a discharge part, and a series of the color image forming operations end.

Process Cartridge/Toner Cartridge

A process cartridge according to the exemplary embodiment will be described.

The process cartridge according to the exemplary embodiment includes a developing unit that includes a container that contains the electrostatic charge image developer according to the exemplary embodiment and develops an electrostatic charge image formed on a surface of an image holding member with the electrostatic charge image developer as a toner image, and is detachable from an image forming apparatus.

The process cartridge according to the exemplary embodiment is not limited to the above-described configuration, and may be configured to include a developing device, and if necessary, at least one selected from other units such as an image holding member, a charging unit, an electrostatic charge image forming unit, and a transfer unit.

Hereinafter, an example of the process cartridge according to the exemplary embodiment will be shown. However, this process cartridge is not limited thereto. Major parts shown in the drawing will be described, but descriptions of other parts will be omitted.

Figure 2:
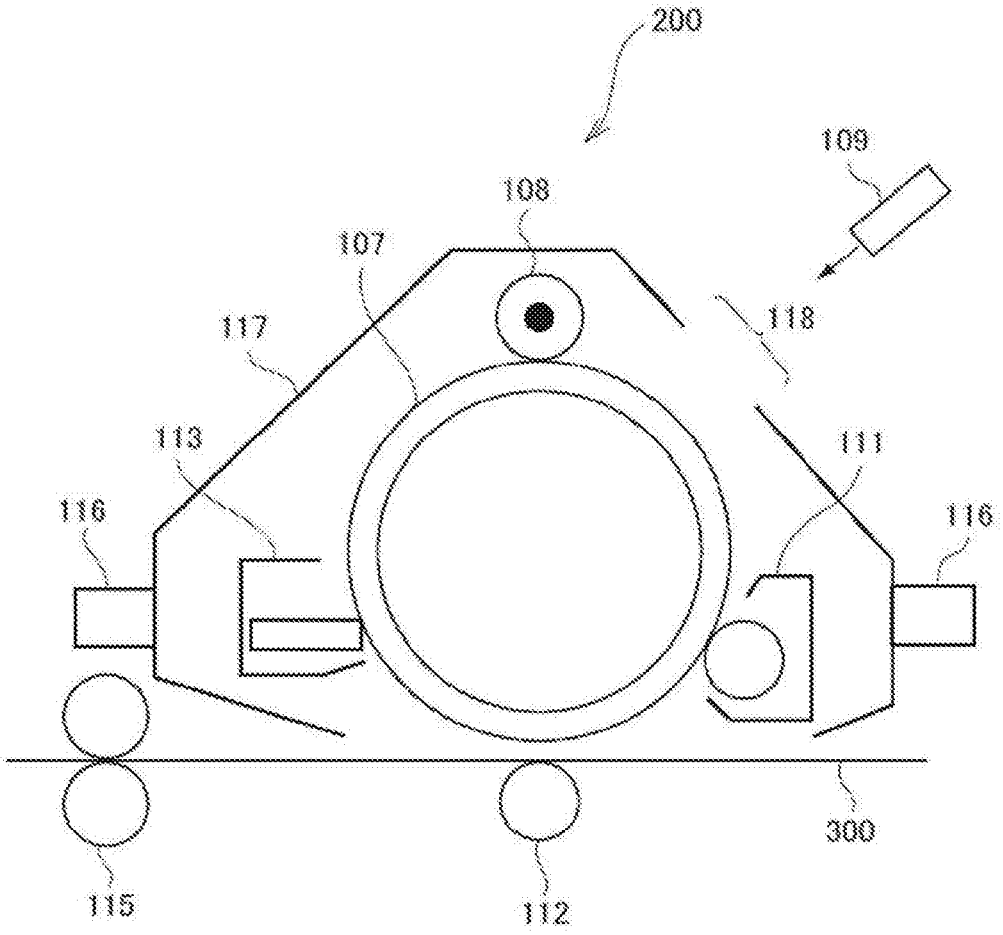
FIG. 2 is a schematic configuration diagram showing a process cartridge according to the exemplary embodiment.

FIG. 2 is a schematic configuration diagram showing the process cartridge according to the exemplary embodiment.

A process cartridge 200 shown in FIG. 2 is formed as a cartridge having a configuration in which a photoreceptor 107 (an example of the image holding member), a charging roll 108 (an example of the charging unit), a developing device 111 (an example of the developing unit), and a photoreceptor cleaning device 113 (an example of the cleaning unit), which are provided around the photoreceptor 107, are integrally combined and held by the use of, for example, a housing 117 provided with a mounting rail 116 and an opening 118 for exposure.

In FIG. 2, the reference numeral 109 represents an exposure device (an example of the electrostatic charge image forming unit), the reference numeral 112 represents a transfer device (an example of the transfer unit), the reference numeral 115 represents a fixing device (an example of the fixing unit), and the reference numeral 300 represents a recording sheet (an example of the recording medium).

Next, a toner cartridge according to the exemplary embodiment will be described.

The toner cartridge according to the exemplary embodiment includes a container that contains the toner according to the exemplary embodiment and is detachable from an image forming apparatus. The toner cartridge includes a container that contains a toner for replenishment for being supplied to the developing unit provided in the image forming apparatus.

The image forming apparatus shown in FIG. 1 has such a configuration that the toner cartridges 8Y, 8M, 8C, and 8K are detachable therefrom, and the developing devices 4Y, 4M, 4C, and 4K are connected to the toner cartridges corresponding to the respective developing devices (colors) via toner supply tubes (not shown), respectively. In addition, in a case where the toner accommodated in the toner cartridge runs low, the toner cartridge is replaced.

EXAMPLES

Hereinafter, the exemplary embodiment of the invention will be described in detail using examples and comparative examples, but the exemplary embodiment of the invention is not limited to the examples. Unless specifically noted, "parts" and "%" represent "parts by weight" and "% by weight".

Preparation of toner particles (A1)

Preparation of amorphous polyester resin particle dispersion (A1)

Terephthalic acid: 30 parts by mol

Fumaric acid: 70 parts by mol

Bisphenol A ethylene oxide adduct: 10 parts by mol

Bisphenol A propylene oxide adduct: 90 parts by mol

The above materials are put in a 5-liter flask including a stirrer, a nitrogen gas introducing tube, a temperature sensor, and a rectifying column, the temperature is increased to 220° C. for 1 hour, 1 part of titanium tetraethoxide with respect to 100 parts of the materials described above is put therein. The temperature is increased to 230° C. for 0.5 hours while distilling away generated water, a dehydration condensation reaction is continued at the temperature for 1 hour, and then the reactant is cooled. By doing so, the amorphous polyester resin (A1) having a weight average molecular weight of 20,000 and an acid value of 13 mgKOH/g is synthesized. A glass transition temperature Tg of the amorphous polyester resin (A1) is 60° C.

Then, 40 parts of ethyl acetate and 25 parts of 2-butanol are put into a container equipped with a temperature adjusting unit and a nitrogen substituting unit to prepare a mixed solution, 100 parts of the amorphous polyester resin (A1) is slowly put therein and dissolved, and 10 weight % ammonia aqueous solution (equivalent to three times amount of the acid value of the resin in terms of mol) is put therein and stirred for 30 minutes.

Then, the atmosphere in the container is substituted with dry nitrogen, the temperature is held at 40° C., and 400 parts of ion exchange water is added dropwise at a rate of 2 parts/min while stirring the mixed solution to perform emulsification. After finishing the adding dropwise, the temperature of the emulsified solution is returned to room temperature (20° C. to 25° C.), bubbling is performed with dry nitrogen for 48 hours while stirring the solution, the content of ethyl acetate and 2-butanol is decreased to 1,000 ppm or smaller, and a resin particle dispersion in which resin particles having a volume average particle diameter of 200 nm are dispersed is obtained. Ion exchange water is added to the resin particle dispersion, solid content is adjusted to 20% by weight, and an amorphous polyester resin particle dispersion (A1) is obtained.

Preparation of Crystalline Polyester Resin Particle Dispersion (A1)

1,10-dodecanedioic acid: 50 parts by mol 1,9-nonanediol: 50 parts by mol

The monomer components are put into a reaction vessel equipped with a stirrer, a thermometer, a condenser, and a nitrogen gas introducing tube, the gas in the reaction vessel is substituted with dry nitrogen gas, and 0.25 parts of titanium tetrabutoxide (reagent) with respect to 100 parts of the monomer components described above is put therein. After stirring and allowing a reaction under the nitrogen gas atmosphere at 170° C. for 3 hours, the temperature is further increased to 210° C. for 1 hour, the pressure in the reaction vessel is reduced to 3 kPa, stirring and a reaction are performed under the reduced pressure for 13 hours, and a crystalline polyester resin (A1) is obtained.

Regarding the obtained crystalline polyester resin (A1), a melting temperature measured by DSC is 73.6° C., a weight average molecular weight Mw measured by GPC is 25,000, a number average molecular weight Mn is 10,500, and an acid value AV is 10.1 mgKOH/g.

Then, 300 parts of the crystalline polyester resin (1), 160 parts of methyl ethyl ketone (solvent), and 100 parts of isopropyl alcohol (solvent) are put in a 3-liter reaction vessel with a jacket (BJ-30N, manufactured by Tokyo Rikakikai Co, Ltd.) which is provided with a condenser, a thermometer, a water dropping device, and an anchor blade, stirred and mixed at 100 rpm to dissolve the resin, while maintaining the temperature in a water circulation type thermostatic bath at 70° C. (dissolved solution preparing method).

After that, the stirring rotation rate is set as 150 rpm, the temperature of the water circulation type thermostatic bath is set as 66° C., 17 parts of 10% ammonia aqueous solution (reagent) is put therein for 10 minutes, total 900 parts of ion exchange water warmed at 66° C. is added dropwise at a rate of 7 parts/min and the phase thereof is inversed, to obtain an emulsified solution.

Immediately, 800 parts of the obtained emulsified solution and 700 parts of ion exchange water are put in a 2-liter eggplant flask and set in an evaporator (Tokyo Rikakikai Co., Ltd.) a vacuum control unit through a trap ball. While rotating the eggplant flask, heating is performed with hot water at 60° C., the pressure is reduced to 7 kPa while paying attention to bumping. The pressure is returned to normal pressure when the amount of the solvent collected becomes 1,100 parts, the eggplant flaks is cooled, and a dispersion is obtained. The obtained dispersion has no smell of the solvent. A volume average particle diameter D50v of the resin particles of the dispersion is 130 nm. After that, the solid content concentration is adjusted to 20% by adding ion exchange water, and this is designated as a crystalline polyester resin particle dispersion (A1).

Preparation of Colorant Particle Dispersion (A1)

Cyan pigment: C.I. Pigment Blue 15:3 (manufactured by Dainichiseika Color & Chemicals Mfg. Co., Ltd., ECB301): 70 parts Anionic surfactant (manufactured by DKS Co., Ltd., NEOGEN RK): 30 parts Ion exchange water: 200 parts The above components are mixed with each other, and dispersed by using a homogenizer (ULTRA TURRAX T50 manufactured by IKA Works, Inc.) for 10 minutes. Ion exchange water is added so that the solid content in the dispersion becomes 20% by weight, and a colorant particle dispersion (A1) in which colorant particles having a volume average particle diameter of 140 nm are dispersed is obtained.

Preparation of Release Agent Particle Dispersion (A1)

Paraffin Wax (HNP-9 manufactured by Nippon Seiro Co., Ltd.): 100 parts

Anionic surfactant (NEOGEN RK manufactured by DKS Co., Ltd.): 1 part

Ion exchange water: 350 parts

The above materials are mixed with each other, heated to 100° C., and dispersed using a homogenizer (ULTRA TURRAX T50 manufactured by IKA Works, Inc.). After that, the mixture is subject to dispersion treatment with MANTON-GAULIN HIGH PRESSURE HOMOGENIZER (manufactured by Gaulin Co., Ltd.), and a release agent particle dispersion (A1) (solid content of 20% by weight) in which release agent particles having a volume average particle diameter of 200 nm are dispersed is obtained.

Preparation of toner particles

Amorphous polyester resin particle dispersion (A1): 425 parts

Crystalline polyester resin particle dispersion (A1): 32 parts

Colorant particle dispersion (A1): 20 parts

Release agent particle dispersion (A1): 50 parts

Anionic surfactant (TaycaPower manufactured by Tayca Corporation): 30 parts

The above materials are put into a round stainless steel flask, 0.1 N of nitric acid is added to adjust the pH to 3.5, and then, 30 parts of a nitric acid aqueous solution having polyaluminum chloride concentration of 10% by weight is added. Then, the resultant material is dispersed at 30° C. using a homogenizer (ULTRA TURRAX T50 manufactured by IKA Works, Inc.), heated to 40° C. in a heating oil bath, and maintained for 30 minutes. After that, 100 parts of the amorphous polyester resin particle dispersion (A1) are gently added and maintained for 1 hour, 0.1 N of sodium hydroxide aqueous solution is added to adjust the pH to 8.5, and the mixture is heated to 100° C. while continuing stirring and maintained for 10 hours. After that, the mixture is cooled (rapidly cooled) to 20° C. at a rate of 20° C./min, then subjected to re-heating (annealing process) up to 55° C., and maintained for 6 hours. Thereafter, the mixture is cooled to 20° C. at a rate of 20° C./min, filtered, and sufficiently washed with ion exchange water, and dried, and toner particles (A1) having a volume average particle diameter of 4.0 μm are obtained.

Preparation of Toner Particles (A2)

Toner particles (A2) are obtained in the same manner as in the preparation of the toner particles (A1), except that the condition of the re-heating process (annealing process) at 55° C. is set to be kept for 0.5 hours.

Preparation of Toner Particles (A3)

Toner particles (A3) are obtained in the same manner as in the preparation of the toner particles (A1), except that the condition of the re-heating process (annealing process) at 55° C. is set to be kept for 10 hours.

Preparation of Toner Particles (A4)

Toner particles (A4) are obtained in the same manner as in the preparation of the toner particles (A1), except that the number of parts of the amorphous polyester resin particle dispersion (A1) and the crystalline polyester resin particle dispersion (A1) which have been put is changed in accordance with Table 1.

Preparation of Toner Particles (A5)

Toner particles (A5) are obtained in the same manner as in the preparation of the toner particles (A1), except that the number of parts of the amorphous polyester resin particle dispersion (A1) and the crystalline polyester resin particle dispersion (A1) which have been put is changed and the condition of the re-heating process (annealing process) at 55° C. is set to be kept for 7 hours, in accordance with Table 1.

Preparation of Toner Particles (P1)

Synthesis of Crystalline Polyester Resin (P1)

80.9 parts of fumaric acid, 46.3 parts of 1,10-decanediol, and 1 part of titanium tetraethoxide with respect to 100 parts of the materials (fumaric acid and 1,10-decanediol) are put in a 5-liter flask equipped with a stirrer, a nitrogen gas introducing tube, a temperature sensor, and a rectifying column. The reaction is performed at 150° C. for 4 hours while removing generated water, and then, the temperature is increased to 180° C. for 6 hours under the nitrogen atmosphere, and the reaction is performed at 180° C. for 6 hours. After that, the reaction is performed under the reduced pressure for 1 hour and cooling is performed, and accordingly, an unmodified crystalline polyester resin (P1) is obtained.

Synthesis of Amorphous Polyester Resin (P1)

30 parts of isophthalic acid, 70 parts of fumaric acid, 5 mol parts of Bisphenol A ethylene oxide adduct, and 95 parts of Bisphenol A propylene oxide adduct are put in a 5-liter flask equipped with a stirrer, a nitrogen gas introducing tube, a temperature sensor, and a rectifying column. The temperature is increased to 220° C. for 1 hour, 1 part of titanium tetraethoxide with respect to 100 parts of the materials (isophthalic acid, fumaric acid, Bisphenol A ethylene oxide adduct, and Bisphenol A propylene oxide adduct) is put therein. The temperature is increased to 230° C. for 0.5 hours while distilling away generated water, a dehydration condensation reaction is continued at the temperature for 1 hour, and then the reactant is cooled. After that, isophorone diisocyanate is added so that the content thereof is 2 parts with respect to 1 part of the resin, 5 parts of ethyl acetate is added and dissolved, the materials are cooled after the reaction at 200° C. for 3 hours, and an amorphous polyester resin (P1) including an isocyanate group at a terminal is obtained.

Preparation of Release Agent Particle Dispersion 100 parts of Paraffin Wax (HNP-9 manufactured by Nippon Seiro Co., Ltd.), 1 part of an anionic surfactant (NEOGEN RK manufactured by DKS Co., Ltd.), and 350 parts of ion exchange water are mixed with each other, heated at 100° C., dispersed using a homogenizer (ULTRA TURRAX T50 manufactured by IKA Works, Inc.). After that, the mixture is subject to dispersion treatment with MANTON-GAULIN HIGH PRESSURE HOMOGENIZER (manufactured by Gaulin Co., Ltd.), and a release agent particle dispersion (solid content of 20% by weight) in which release agent particles having a volume average particle diameter of 200 nm are dispersed is obtained.

Preparation of Masterbatch 150 parts of the amorphous polyester resin (P1), 80 parts of a cyan pigment (pigment 15:3, manufactured by Dainichiseika Color & Chemicals Mfg. Co., Ltd.), and 20 parts of ion exchange water are mixed with each other using a HENSCHEL MIXER. The obtained mixture is pulverized and a masterbatch is prepared.

Preparation of Oil Phase (A)/Water Phase 107 parts of the amorphous polyester resin (P1), 75 parts of the release agent particle dispersion, 18 parts of the masterbatch, and 73 parts of ethyl acetate are put together, stirred using a homogenizer (ULTRA TURRAX T50 manufactured by IKA Works, Inc.), and dissolved and dispersed, and an oil phase (A) is obtained. 990 parts of ion exchange water, 100 parts of an anionic surfactant, and 100 parts of ethyl acetate are mixed and stirred in another flask and a water phase is obtained.

Emulsification Dispersion 100 parts of a solution (solid content concentration of 10%) obtained by dissolving the crystalline polyester resin (P1) in ethyl acetate and 3 parts of isophorodiamine are added to 450 parts of the oil phase (A), stirred using a homogenizer (ULTRA TURRAX T50 manufactured by IKA Works, Inc.), dissolved and dispersed at 50° C., and an oil phase (B) is obtained. Next, 400 parts of the water phase is put in another container and stirred at 50° C. using a homogenizer (ULTRA TURRAX T50 manufactured by IKA Works, Inc.). 50 parts of the oil phase (B) is added to the water phase and stirred using a homogenizer (ULTRA TURRAX T50 manufactured by IKA Works, Inc.) at 50° C. for 5 minutes, and an emulsified slurry is obtained. By performing desolvation of the emulsified slurry at 50° C. for 15 hours, a toner slurry is obtained. The toner slurry is filtered under the reduced pressure and subjected to a cleaning treatment, and toner particles are obtained.

Then, after washing, a dispersion obtained by adding 50 parts of the toner particles and 500 parts of ion exchange water is stirred in a 5-liter flask equipped with a stirrer, a nitrogen gas introducing tube, a temperature sensor, and a rectifying column and is heated to 85° C. After being heated, the dispersion is stirred for 24 hours while maintaining the heating temperature. Accordingly, the toner particles are heated at 85° C. for 24 hours. Then, liquid nitrogen is introduced to the dispersion and the toner particles are cooled (rapidly cooled) at 20° C./min, to room temperature (25° C.). Then, re-heating is performed to 55° C., and the toner particles are held for 7 hours. Then, the toner particles are cooled to 20° C. at a rate of 20° C./min.

Drying and Sieving

By drying and sieving the obtained toner particles, toner particles having a volume average particle diameter of 7 μm are prepared.

The toner particles (P1) are obtained through the processes described above.

Preparation of Brilliant Toner Particles (B1)

Preparation of Brilliant Pigment Dispersion

Aluminum pigment (manufactured by Toyo Aluminum Corporation, 2173EA, 6 μm): 100 parts Anionic surfactant (manufactured by DKS Co., Ltd, NEOGEN R): 1.5 parts Ion exchange water: 400 parts A solvent is removed from a paste of the aluminum pigment, and the pigment is mechanically pulverized to 5.2 μm and classified by using a star mill (manufactured by Ashizawa Finetech Ltd., LMZ). Then, the surfactant and the ion exchange water are mixed and dispersed by using an emulsifying and dispersing machine CAVITRON (manufactured by Pacific machinery and engineering Co., Ltd, CR1010) for about one hour, and thus a brilliant pigment dispersion obtained by dispersing brilliant pigment particles (aluminum pigment) is prepared (solid content concentration: 20% by weight). A pigment dispersing diameter is 5.2 μm.

Preparation of Brilliant Toner Particles

Brilliant pigment dispersion: 150 parts

Amorphous polyester resin particle dispersion (A1): 380 parts

Crystalline polyester resin particle dispersion (A1): 75 parts

Release agent particle dispersion (A1): 75 parts

The components are put into a 2 L columnar stainless steel container, and are dispersed and mixed for 10 minutes by a homogenizer (ULTRA TURRAX T50 manufactured by IKA Works, Inc.), while a shearing force is applied at 4,000 rpm. Then, 1.75 parts of a 10% nitric acid aqueous solution of aluminum chloride is slowly dropped as an aggregating agent, and dispersing and mixing is performed for 15 minutes at the number of rotations of a homogenizer, which is set to 5,000 rpm. Thus, a raw material dispersion is obtained.

Then, the dispersion is sent to a polymerizing pot which includes a stirring device using a stirring blade having four paddles and a thermometer. Heating starts in a mantle heater, at the number of stirring rotations, which is set to 1,000 rpm, and thus growth of aggregation particles is accelerated at 54° C. At this time, pH of the dispersion is controlled to be in a range of 2.2 to 3.5 by using 0.3 mol/L nitric acid or a 1 mol/L sodium hydroxide aqueous solution. The dispersion is held in the pH range for about 2 hours, thereby aggregation particles are formed.

Then, 70 parts of the amorphous polyester resin particle dispersion (A1) is added, and amorphous polyester resin particles are adhered to the surface of the aggregation particles. Further, the temperature is increased to 56° C., and aggregation particles are prepared while the size and the form of the particle are confirmed by an optical microscope and MULTISIZER II. After that, 3.25 parts of a chelating agent (HIDS, manufactured by Nippon Shokubai Co., Ltd) are added, and then pH is adjusted to 7.8 by using a 5% sodium hydroxide aqueous solution. Then, the dispersion is held for 15 minutes. After that, in order to coalesce the aggregation particles, pH is increased to 8.0, and then the temperature is increased to 67.5° C. After coalescence of the aggregation particles is confirmed by an optical microscope, pH is decreased to 6.0 in a state of being held at 67.5° C. After one hour, heating is stopped, and cooling is performed at a rate of temperature decrease of 1.0° C./min. After that, re-heating (annealing process) is performed up to 55° C., and holding is performed for 6 hours. Then, cooling is performed at a rate of temperature decrease of 1.0° C./min. Then, sieving is performed by a mesh of 40 μm, and water washing is repeated. Then, drying is performed in a vacuum dryer, thereby toner particles are obtained. A volume average particle diameter of the obtained toner particles is 11.5 The obtained toner particles are designated as brilliant toner particles (B1).

Preparation of Toner Particles (C1)

Toner particles (C1) are obtained in the same manner as in the preparation of the toner particles (A1), except for not performing the re-heating process up to 55° C. in preparing the toner particles (A1).

Preparation of Toner Particles (C2)

Toner particles (C2) are obtained in the same manner as in the preparation of the toner particles (A1), except that, after pH is adjusted to 8.5, the dispersion is heated to 100° C. with continuously stirring, and is held for 10 hours, and then the dispersion is cooled to 20° C. at a rate of 1° C./min, re-heated to 55° C., held for 0.2 hours, and is cooled to 20° C. at a rate of 20° C./min.

Preparation of Toner Particles (C3)

Toner particles (C3) are obtained in the same manner as in the preparation of the toner particles (A1), except that 30 parts of the following silica particle dispersion (inorganic filler dispersion) are used instead of 32 parts of the crystalline resin particle dispersion (A1).

In the toner particle (C3), the content of silica particles with respect to the amorphous resin is 7% by weight.

Preparation of Silica Particle Dispersion

Silica particles (Shin-etsu Chemical Co., Ltd, QSG-100): 70 parts

Anionic surfactant (manufactured by DKS Co., Ltd, NEOGEN RK): 30 parts

Ion exchange water: 200 parts

The materials are mixed and dispersed for 10 minutes by using a homogenizer (ULTRA TURRAX T50 manufactured by IKA Works, Inc.). Ion exchange water is added so as to cause solid content concentration in the dispersion to be 20% by weight, and thus a silica particle dispersion in which silica particles having a volume average particle diameter of 110 nm are dispersed is obtained.

Preparation of Toner Particles (C4)

Toner particles (C4) are obtained in the same manner as in the preparation of the toner particles (A1), except that parts of a PMMA particle dispersion (organic filler dispersion having a high glass transition temperature) described below are used instead of 32 parts of the crystalline resin particle dispersion (A1).

In the toner particle (C4), the content of PMMA particles with respect to the amorphous resin is 7% by weight.

Preparation of PMMA Particle Dispersion

PMMA (polymethyl methacrylate) particles (manufactured by Soken Chemical and engineering Co., Ltd, MP-1451, Tg128): 70 parts Anionic surfactant (manufactured by DKS Co., Ltd, NEOGEN RK): 30 parts Ion exchange water: 200 parts The materials are mixed and dispersed for 10 minutes by using a homogenizer (ULTRA TURRAX 150 manufactured by IKA Works, Inc.). Ion exchange water is added so as to cause solid content concentration in the dispersion to be 20% by weight, and thus a PMMA particle dispersion in which PMMA particles having a volume average particle diameter of 150 nm are dispersed is obtained.

Examples 1 to 7 and Comparative Examples 1 to 4

100 parts of each of the obtained toner particles and 0.7 parts of dimethyl silicone oil-treated silica particles (RY200 manufactured by Nippon Aerosil Co., Ltd.) are mixed with each other with a HENSCHEL MIXER and a toner of each example is obtained.

8 parts of each of the obtained toners and 100 parts of a carrier described below are mixed with each other to obtain a developer of each example.

Preparation of Carrier

Ferrite particles (average particle diameter of 50 μm): 100 parts

Toluene: 14 parts

Styrene-methyl methacrylate copolymer (copolymerization ratio 15/85): 3 parts

Carbon black: 0.2 parts

The components except for the ferrite particles are dispersed in a sand mill so as to prepare a dispersion. The dispersion and the ferrite particles are put into a vacuum degassing type kneader, dried while stirring under the reduced pressure, and a carrier is obtained.

Measurement

Regarding the toner of the developer of each example, an area ratio a (%) of the crystalline resin of the toner particles on a cross section of toner particles before being heated [described as "area ratio a of crystalline resin before being heated" in Table], and an area ratio b (%) of the crystalline resin on the cross section of the toner particles after being heated [described as "area ratio b of crystalline resin after being heated" in Table") are obtained by the method described above.

A domain diameter of the crystalline resin and the number of domains of the crystalline resin per unit area on the cross section of the toner particles are obtained by the method described above.

The results thereof are shown in Table 2.

Evaluation

The following evaluation is performed by using the obtained developers. The results thereof are shown in Table 2. A work of performing evaluation and image formation is performed in an environment at a temperature of 33° C./humidity of 90%.

Evaluation of Image Defect by Toner Filming

ApeosPort IV C4470 manufactured by Fuji Xerox Co., Ltd. is prepared as an image forming apparatus of forming an evaluation image, and the obtained developer is put into a developing machine, and a toner for replenishment (toner which is the same as a toner included in the developer) is put into a toner cartridge. 25,000 sheets of a halftone image of 5 cm×5 cm, which has an image area ratio 50% and a solid image of 5 cm×5 cm, which has an image area ratio 100% are continuously output on high-quality paper (P paper, manufactured by Fuji Xerox Co., Ltd., product name of P, basis weight of 64 g/m$^2$, paper thickness of 88 μm, kept for one week at a temperature 33° C./humidity of 90%) at a process speed of 445 mm/sec by the image forming apparatus. Visual evaluation for image defect by toner filming on the 10,000-th halftone image, visual evaluation for image defect by toner filming on the 25,000-th halftone image, and evaluation of bending strength on the solid image are performed. Evaluation criteria are as follows.

Here, image defect by toner filming is evaluated regarding color irregularity in the halftone image occurring by toner filming onto a surface of the charging roll.

Evaluation criteria are as follows. A and B are set to be passed.

A: no image defect by toner filming.

B: occurrence of small image defect (color irregularity) by toner filming partially (in a range of being less than 10% in the halftone image).

C: occurrence of image defect (color irregularity) by toner filming partially (in a range of 10% to 50% in the halftone image).

D: occurrence of image defect (color irregularity) by toner filming on the entire surface (in a range of being more than 50% in the halftone image).

Fixing Properties Evaluation

Regarding evaluation of fixing properties, an image surface of the solid image portion is bent by using a weight of a predetermined load, and a bent portion is rubbed by a gauze. A degree of the image damaged by the rubbing is visually observed, and bending strength of the image is evaluated based on the following criteria. G4 and G5 are set to be passed.

G1: an image at a portion other than a bent portion is damaged with rubbing with a gauze, and a state where fixing is hardly possible occurs.

G2: if an image is rubbed by a gauze, a white stripe having a wide width is formed in the image in a bent portion and the surroundings, and thus the image is damaged.

G3: if an image is rubbed by a gauze, a white stripe is formed in the image at a bent portion, and thus image is damaged, and cracks and the like occur in the image in the surroundings.

G4: if an image is rubbed by a gauze, only image damage of a very-fine white stripe occurs only at a bent portion. A level of no practical problem.

G5: Though an image is rubbed by a gauze, image damage hardly occurs. A degree of understanding bending history.

TABLE 1

| Example | Type of toner particle | Amorphous PE resin particle dispersion A1 (charged amount) | Crystalline PE resin particle dispersion A1 (charged amount) | Percentage (% by weight) of crystalline resin to amorphous resin | Keeping time (time h) in annealing process | Area ratio a (%) of crystalline resin before being heated | Area ratio b (%) of crystalline resin after being heated | a/b |
|---|---|---|---|---|---|---|---|---|
| Example 1 | A1 | 425 | 32 | 7.0 | 6 | 19 | 19.8 | 0.96 |
| Example 2 | A2 | 425 | 32 | 7.0 | 0.5 | 16.7 | 18.5 | 0.90 |
| Example 3 | A3 | 425 | 32 | 7.0 | 10 | 19.8 | 20.1 | 0.99 |
| Example 4 | A4 | 440 | 19 | 4.1 | 6 | 10.2 | 10.7 | 0.95 |
| Example 5 | A5 | 167 | 50 | 23.0 | 7 | 61.2 | 63.8 | 0.96 |
| Example 6 | P1 | — | — | 7.0 | 7 | 17.7 | 18.6 | 0.95 |
| Example 7 | B1 | 380 | 75 | 19.7 | 6 | 14.5 | 15.3 | 0.95 |
| Comparative Example 1 | C1 | 425 | 32 | 7.0 | 0 | 15.1 | 19.1 | 0.79 |
| Comparative Example 2 | C2 | 425 | 32 | 7.0 | 0.2 | 16.5 | 18.8 | 0.88 |
| Comparative Example 3 | C3 | 450 | 0 | 0 | 5 | 0 | 0 | 0 |
| Comparative Example 4 | C4 | 450 | 0 | 0 | 5 | 0 | 0 | 0 |

TABLE 2

| Example | Domain diameter (nm) of crystalline resin | Number (piece) of domains of crystalline resin | Image defect by toner filming 10,000th sheet | Image defect by toner filming 25,000th sheet | Fixing properties |
|---|---|---|---|---|---|
| Example 1 | 15 | 65 | A | A | G5 |
| Example 2 | 13 | 48 | B | B | G5 |
| Example 3 | 14 | 61 | A | A | G5 |
| Example 4 | 13 | 32 | B | A | G5 |
| Example 5 | 14 | 154 | A | B | G4 |
| Example 6 | 15 | 57 | A | A | G4 |
| Example 7 | 13 | 70 | A | A | G4 |
| Comparative Example 1 | 32 | 13 | B | D | G4 |
| Comparative Example 2 | 16 | 41 | B | C | G5 |
| Comparative Example 3 | 0 | 0 | A | A | G2 |
| Comparative Example 4 | 0 | 0 | A | B | G3 |

From the above results, it is found that, in Examples, the occurrence of toner filming is prevented and the occurrence of image defects due to toner filming is also prevented even when an image is formed at a fast process speed (feeding speed of a recording medium) in a high temperature and high humidity environment, unlike in Comparative Examples. It is found that, in Examples, the result of good fixing properties is obtained.

It is found that, in Comparative Examples 3 and 4, the occurrence of toner filming is prevented and the occurrence of image defects due to toner filming is also prevented, but, since silica particles or PMMA particles are mixed in toner particles, fixing properties are deteriorated.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An electrostatic charge image developing toner comprising:

toner particles each including an amorphous resin and a crystalline resin, wherein, when the toner particles are subjected to a measurement to determine an area ratio of the crystalline resin on a cross section of the toner particle before and after being heated at a temperature of 50° C. and a humidity of 50% RH for three days, a relationship between an area ratio a (%) of the crystalline resin on a cross section with respect to the toner particles before being heated and an area ratio b (%) of the crystalline resin on the cross section with respect to the toner particles after being heated satisfies Expression (1): $0.9 \leq a/b \leq 1.0$.

2. The electrostatic charge image developing toner according to claim 1, wherein the toner particle includes a brilliant pigment.

3. The electrostatic charge image developing toner according to claim 1, wherein the number of island portions including the crystalline resin (the number of domains of the crystalline resin) is from 10 to 200 per unit area (1 μm×1 μm) on a cross section of the toner particle.

4. The electrostatic charge image developing toner according to claim 1, wherein a weight ratio between the amorphous resin and the crystalline resin (amorphous resin/crystalline resin) is from 50/50 to 97/3.

5. The electrostatic charge image developing toner according to claim 1, wherein the amorphous resin and the crystalline resin each include a polyester resin.

6. The electrostatic charge image developing toner according to claim 1, wherein the amorphous resin is urea-modified polyester resin, and the crystalline resin is a crystalline polyester resin.

7. The electrostatic charge image developing toner according to claim 1, wherein a glass transition temperature of the amorphous resin is from 50° C. to 65° C., and a melting temperature of the crystalline resin is from 60° C. to 85° C.

8. The electrostatic charge image developing toner according to claim 1, wherein the toner particles include a release agent having a melting temperature of 50° C. to 110° C.

9. The electrostatic charge image developing toner according to claim 2, wherein the brilliant pigment is aluminum.

10. The electrostatic charge image developing toner according to claim 2, wherein an aspect ratio of the brilliant pigment is from 5 to 200.

11. An electrostatic charge image developer comprising:

the electrostatic charge image developing toner according to claim 1.

12. A toner cartridge comprising:

a container that contains the electrostatic charge image developing toner according to claim 1, wherein the toner cartridge is detachable from an image forming apparatus.

13. The electrostatic charge image developing toner according to claim 1, wherein the number of island portions including the crystalline resin (the number of domains of the crystalline resin) is from 20 to 100 per unit area (1 μm×1 μm) on a cross section of the toner particle.

* * * * *